US010599058B2

(12) United States Patent
Nemoto et al.

(10) Patent No.: US 10,599,058 B2
(45) Date of Patent: Mar. 24, 2020

(54) TONER, DEVELOPER, TONER STORAGE UNIT, IMAGE FORMING APPARATUS, AND IMAGE FORMING METHOD

(71) Applicants: Taichi Nemoto, Shizuoka (JP); Toma Takebayashi, Shizuoka (JP)

(72) Inventors: Taichi Nemoto, Shizuoka (JP); Toma Takebayashi, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/238,566

(22) Filed: Jan. 3, 2019

(65) Prior Publication Data

US 2019/0227449 A1 Jul. 25, 2019

(30) Foreign Application Priority Data

Jan. 24, 2018 (JP) ..... 2018-009690

(51) Int. Cl.
*G03G 9/08* (2006.01)
*G03G 9/087* (2006.01)
*G03G 15/08* (2006.01)

(52) U.S. Cl.
CPC ..... *G03G 9/0821* (2013.01); *G03G 9/0825* (2013.01); *G03G 9/08755* (2013.01);
(Continued)

(58) Field of Classification Search
CPC ..... G03G 9/0821; G03G 15/0865; G03G 9/08755
See application file for complete search history.

(56) References Cited

U.S. PATENT DOCUMENTS

2013/0065172 A1 3/2013 Moriya et al.
2013/0202996 A1* 8/2013 Yamauchi ..... G03G 9/0821 430/105

(Continued)

FOREIGN PATENT DOCUMENTS

JP 2008-287088 11/2008
JP 2013-076975 4/2013

(Continued)

OTHER PUBLICATIONS

Imoto, Minoru. Basic Theory of Gluing, Macromolecule Publication Meeting, pp. 89-103.

(Continued)

*Primary Examiner* — Thorl Chea
(74) *Attorney, Agent, or Firm* — Oblon, McClelland, Maier & Neustadt, L.L.P.

(57) ABSTRACT

A toner comprising a binder resin is provided. When the toner is observed with an atomic force microscope in tapping mode to obtain a phase image and the phase image is binarized with an intermediate value between maximum and minimum phase difference values in the phase image to obtain a binarized image, the binarized image consists of first phase-contrast portions having a large phase difference and second phase-contrast portions having a small phase difference, where the first phase-contrast portions are dispersed in the second phase-contrast portions and a dispersion diameter of the first phase-contrast portions is in a range of from 150 to 500 nm. The toner has at least two glass transition temperatures (Tg) in respective ranges of from 40° C. to 65° C. and from −30° C. to 20° C., determined from a DSC curve obtained at a first temperature rise in a differential scanning calorimetric measurement by a midpoint method.

12 Claims, 6 Drawing Sheets

(52) U.S. Cl.
CPC ..... *G03G 9/08795* (2013.01); *G03G 9/08797* (2013.01); *G03G 15/0865* (2013.01)

(56) References Cited

U.S. PATENT DOCUMENTS

| | | | |
|---|---|---|---|
| 2014/0080050 | A1 | 3/2014 | Asahina et al. |
| 2015/0132690 | A1 | 5/2015 | Asahina et al. |
| 2018/0267417 | A1 | 9/2018 | Mizoguchi et al. |

FOREIGN PATENT DOCUMENTS

| | | |
|---|---|---|
| JP | 2014-077979 | 5/2014 |
| JP | 2015-072442 | 4/2015 |
| JP | 2015-092212 | 5/2015 |
| JP | 2015-148724 | 8/2015 |

OTHER PUBLICATIONS

Robert F. Fedors, "A Method for Estimating Both the Solubility Parameters and Molar Volumes of Liquids",Polymer Engineering and Science, Feb. 1974, vol. 14, No. 2, p. 147-154.
Q. Zhong, D. Inniss, et al.,"Fractured Polymer / silica fiber surface studied by tapping mode atomic force microscopy",Surface Science Letters 290 L688-692 (1993).
R. van den Berg, et al. "Atomic force microscopy of thin triblock copolymer films",Polymer communications, vol. 35 No. 26, 1994, p. 5778-5781.
M. A. van Dijk, et al."Ordering Phenomena in Thin Block Copolymer Films Studied Using Atomic Force Microscopy", Macromolecules 1995, 28, 6773-6778.

* cited by examiner

TONER, DEVELOPER, TONER STORAGE UNIT, IMAGE FORMING APPARATUS, AND IMAGE FORMING METHOD

CROSS-REFERENCE TO RELATED APPLICATIONS

This patent application is based on and claims priority pursuant to 35 U.S.C. § 119(a) to Japanese Patent Application No. 2018-009690, filed on Jan. 24, 2018, in the Japan Patent Office, the entire disclosure of which is hereby incorporated by reference herein.

BACKGROUND

Technical Field

The present disclosure relates to a toner, a developer, a toner storage unit, an image forming apparatus, and an image forming method.

Description of the Related Art

In a conventional electrophotographic image forming apparatus, a latent image is electrically or magnetically formed and visualized with toner. For example, in electrophotography, an electrostatic latent image is formed on a photoconductor and developed into a toner image with toner. The toner image is transferred onto a recording medium, such as paper, and fixed thereon. In fixing the toner image on the recording medium, a heat fixing method such as a heat roller fixing method and a heat belt fixing method is widely employed for its high energy efficiency.

In recent years, there has been an increasing demand for high-speed and energy-saving image forming apparatuses. In accordance with this demand, toner that has excellent low-temperature fixability and provides high quality image is required. One approach for achieving low-temperature fixability of toner involves reducing the softening temperature of the binder resin of the toner. However, when the softening temperature of the binder resin is low, a phenomenon called offset is likely to occur in which a part of the toner image is adhered to the surface of a fixing member and then retransferred onto a recording medium in the fixing process. In addition, heat-resistant storage stability of the toner deteriorates. As a result, a phenomenon called blocking occurs in which toner particles are fused with each other particularly in high-temperature environments. Furthermore, another problem may occur such that toner is fused to contaminate a developing device or carrier particles or such that toner is formed into a film on a surface of a photoconductor.

SUMMARY

In accordance with some embodiments of the present invention, a toner is provided. The toner comprises a binder resin. When the toner is observed with an atomic force microscope (AFM) in tapping mode to obtain a phase image and the phase image is binarized with an intermediate value between maximum and minimum phase difference values in the phase image to obtain a binarized image, the binarized image consists of first phase-contrast portions having a large phase difference and second phase-contrast portions having a small phase difference, where the first phase-contrast portions are dispersed in the second phase-contrast portions and a dispersion diameter of the first phase-contrast portions is in a range of from 150 to 500 nm. The toner has at least two glass transition temperatures (Tg) in respective ranges of from 40° C. to 65° C. and from −30° C. to 20° C., determined from a DSC curve obtained at a first temperature rise in a differential scanning calorimetric (DSC) measurement by a midpoint method.

In accordance with some embodiments of the present invention, a developer is provided. The developer comprises the above-described toner.

In accordance with some embodiments of the present invention, a toner storage unit is provided. The toner storage unit includes a container and the above-described toner stored in the container.

In accordance with some embodiments of the present invention, an image forming apparatus is provided. The image forming apparatus includes: an electrostatic latent image bearer; an electrostatic latent image forming device configured to form an electrostatic latent image on the electrostatic latent image bearer; and a developing device containing the above-described toner, configured to develop the electrostatic latent image with the toner into a toner image.

In accordance with some embodiments of the present invention, an image forming method is provided. The image forming method includes the processes of forming an electrostatic latent image on an electrostatic latent image bearer and developing the electrostatic latent image with the above-described toner into a toner image.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
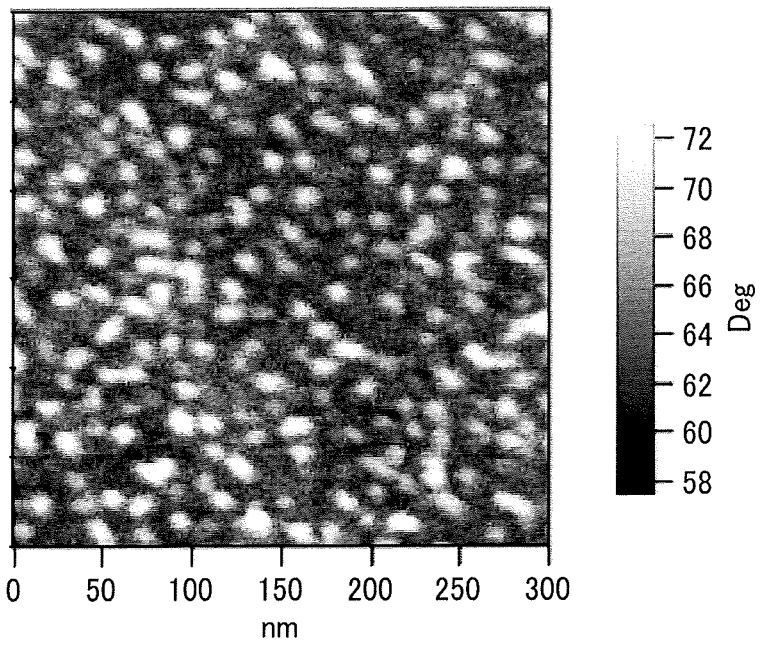
FIG. 1 is an example of a phase image of a toner.

The accompanying drawings are intended to depict example embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that have a similar function, operate in a similar manner, and achieve a similar result.

For the sake of simplicity, the same reference number will be given to identical constituent elements such as parts and materials having the same functions and redundant descriptions thereof omitted unless otherwise stated.

According to an embodiment of the present invention, a toner is provided that provides an image having excellent low glossiness while achieving both low-temperature fixability and heat resistant storage stability at high levels.

Hereinafter, a toner, a developer, a developer for replenishment, a toner storage unit, an image forming apparatus, and an image forming method according to some embodiments of the present invention are described in detail.

Toner

The toner according to an embodiment of the present invention includes at least a binder resin and optionally other known components as necessary. Preferably, the binder resin comprises at least two types of resins differing in solubility parameter (hereinafter "SP") determined by the Fedors' method by 0.5 or more. More preferably, the binder resin comprises at least two types of amorphous polyester resins satisfying the above requirement for SP. It is particularly preferable that the two types of amorphous polyester resins form a phase separation structure of a matrix resin and a domain resin, so that light interference occurs at the interface of these resins due to the difference in refractive index therebetween, thereby exhibiting low glossiness.

When the toner according to an embodiment of the present invention is observed with an atomic force microscope (AFM) in tapping mode to obtain a phase image and the phase image is binarized with an intermediate value between the maximum and minimum phase difference values in the phase image to obtain a binarized image, the binarized image consists of first phase-contrast portions having a large phase difference and second phase-contrast portions having a small phase difference, where the first phase-contrast portions are dispersed in the second phase-contrast portions and a dispersion diameter of the first phase-contrast portions is in the range of from 150 to 500 nm. When the dispersion diameter of the first phase-contrast portions is less than 150 nm, development of low glossiness is insufficient. To achieve both low glossiness and heat resistant storage stability (described later), the upper limit of the dispersion diameter of the first phase-contrast portions is 500 nm. More preferably, the dispersion diameter of the first phase-contrast portions is in the range of from 200 to 400 nm.

In the present disclosure, the structure in which the first phase-contrast portions are dispersed in the second phase-contrast portions refers to a structure in which, in the binarized image, the boundary between the first phase-contrast portions (domains) and the second phase-contrast portions (domains) can be defined and the Feret diameter of the first phase-contrast portions can be defined. When the first phase-contrast portions in the binarized image has an ultrafine particle diameter and is indistinguishable from image noise or when it is impossible to clearly define the Feret diameter of the first phase-contrast portions, it is determined that the dispersed structure is not established. When the first phase-contrast portions are indistinguishable from image noise and it is impossible to define a boundary between the first phase-contrast portions (domains) and the second phase-contrast portions (domains), it is impossible to determine the Feret diameter of the first phase-contrast portions. The first phase-contrast portions with which the Feret diameter can be determined may be in a shape of dots or in a periodic structure. Examples of the periodic structure include a stratiform structure typified by a columnar structure, and a mille-feuille-like structure.

On the other hand, low-temperature fixability is exhibited when the glass transition temperature of the binder resin is reduced to make the binder resin plastically deformable easily. However, this results in deterioration of heat-resistant storage stability. To achieve both low-temperature fixability and heat-resistant storage stability at the same time, it is preferable that the matrix resin has a high glass transition temperature and the domain resin has a low glass transition temperature. The upper limit of the domain diameter of the domain resin is 500 nm for heat resistant storage stability.

The toner has at least two glass transition temperatures (Tg) in respective ranges of from 40° C. to 65° C. and from −30° C. to 20° C., determined from a DSC curve obtained at the first temperature rise in a differential scanning calorimetric (DSC) measurement by a midpoint method. The glass transition temperature in the range of from 40° C. to 65° C. corresponds to that of the matrix resin. The glass transition temperature in the range of from −30° C. to 20° C. corresponds to that of the domain resin.

More preferably, the two glass transition temperatures are in respective ranges of from 50° C. to 60° C. and from −10° C. to 10° C.

The specific requirement of the embodiment of the present invention "when the toner is observed with an atomic force microscope (AFM) in tapping mode to obtain a phase image and the phase image is binarized with an intermediate value between maximum and minimum phase difference values in the phase image to obtain a binarized image, the binarized image consists of first phase-contrast portions having a large phase difference and second phase-contrast portions having a small phase difference, where the first phase-contrast portions are dispersed in the second phase-contrast portions and a dispersion diameter of the first phase-contrast portions is in the range of from 150 to 500 nm" may be achieved when the binder resin comprises two types of resins (preferably two types of amorphous polyester resins) differing in solubility parameter determined by the Fedors' method by 0.5 or more.

Specifically, it is preferable that the binder resin comprises two types of amorphous polyester resins where one of them is a matrix resin and the other is a domain resin satisfying the following relation.

$$2 \geq \Delta SP(\text{SP of Matrix Resin} - \text{SP of Domain Resin}) \geq 0.5$$

When ΔSP is less than 0.5, the matrix and domain resins become compatible with each other, so that the specific requirement is not satisfied. Furthermore, the toner is not able to have two glass transition temperatures, which fails to achieve the effect of the present invention. When ΔSP is greater than 2, the two glass transition temperatures are clearly separated, however, the domain resin is likely to become coarse. Therefore, ΔSP is preferably 2 or less. More preferably, ΔSP is in the range of from 1 to 2.

Here, the solubility parameter (SP) is described in detail below.

Solubility Parameter (SP)

Solubility parameter (SP) refers to a numerical value indicating solvency behavior of one material to another material. SP is represented by the square root of cohesive energy density (CED) that indicates an intermolecular attracting force. The cohesive energy density is the amount of energy needed for vaporizing 1 mL of a material.

In the present disclosure, SP is calculated from the following formula (I) based on the Fedors' method.

$$\text{SP(Solubility Parameter)}=(\text{CED})^{1/2}=(E/V)^{1/2} \quad \text{Formula (I)}$$

In the formula (I), E represents molecular cohesive energy (cal/mol) and V represents molecular volume ($cm^3$/mol). E and V are represented by the following formulae (TI) and (III), respectively, where Δei and Δvi respectively represent vaporization energy and molar volume of an atomic group.

$$E=\Sigma\Delta ei \quad \text{Formula (II)}$$

$$V=\Sigma\Delta vi \quad \text{Formula (III)}$$

Detail of the above calculation method and data of vaporization energy Δei and molar volume Δvi of various atomic groups are available in a publication "Imoto, M., Basic Theory of Gluing, Macromolecule Publication Meeting, Chapter 5".

Data unavailable in this publication, such as data for —$CF_3$ group, may be obtained from a document "Fedors, Robert F., Polymer Engineering and Science, 1974, Vol. 14, No. 2, 147-154".

For reference, the SP expressed by the formula (I) can be converted to have a unit of $(J/cm^3)^{1/2}$ or an SI unit $(J/m^3)^{1/2}$ by being multiplied by 2.046 or 2,046, respectively.

It is generally difficult to calculate SP of a resin from the composition ratio of raw materials in a case in which the resin is produced by a polymerization process during which a monomer is added to change the resin backbone structure. It is also difficult to calculate SP of a toner since the composition thereof is often unknown. By contrast, the Fedors' method makes it possible to calculate SP by specifying the type and ratio of the monomers constituting the resin.

As described above, the binder resin according to an embodiment of the present invention preferably comprises a matrix resin having a high glass transition temperature and a domain resin having a low glass transition temperature, and the mass ratio of the matrix resin to the domain resin is preferably from 95/5 to 70/30, more preferably from 90/10 to 80/20.

The composition of the amorphous polyester resin according to an embodiment of the present invention may be determined taking into consideration the affinity with a colorant or a release agent such as a wax (described later). For example, the below-described monomers may be selected.

Diol Component

Specific examples of the diol component include, but are not limited to: aliphatic diols such as ethylene glycol, 1,2-propylene glycol, 1,3-propylene glycol, 1,4-butanediol, 2-methyl-1,3-propanediol, 1,5-pentanediol, 3-methyl-1,5-pentanediol, 1,6-hexanediol, 1,8-octanediol, 1,10-decanediol, and 1,12-dodecanediol; oxyalkylene-group-containing diols such as diethylene glycol, triethylene glycol, dipropylene glycol, polyethylene glycol, polypropylene glycol, and polytetramethylene glycol; alicyclic diols such as 1,4-cyclohexanedimethanol and hydrogenated bisphenol A; alkylene oxide (e.g., ethylene oxide, propylene oxide, and butylene oxide) adducts of alicyclic diols; bisphenols such as bisphenol A, bisphenol F, and bisphenol S; and alkylene oxide (e.g., ethylene oxide, propylene oxide, and butylene oxide) adducts of bisphenols. Among these, aliphatic diols having 4 to 12 carbon atoms are preferable.

Each of these diols can be used alone or in combination with others.

Dicarboxylic Acid Component

Examples of the dicarboxylic acid include, but are not limited to, aliphatic dicarboxylic acids and aromatic dicarboxylic acids. In addition, anhydrides, lower alkyl (C1-C3) esters, and halides thereof may also be used.

Specific examples of the aliphatic dicarboxylic acids include, but are not limited to, succinic acid, adipic acid, sebacic acid, dodecanedioic acid, maleic acid, and fumaric acid.

Specific preferred examples of the aromatic dicarboxylic acids include, but are not limited to, those having 8 to 20 carbon atoms.

Specific examples of the aromatic dicarboxylic acids having 8 to 20 carbon atoms include, but are not limited to, phthalic acid, isophthalic acid, terephthalic acid, and naphthalene dicarboxylic acids.

Among these dicarboxylic acids, aliphatic dicarboxylic acids having 4 to 12 carbon atoms are preferable.

Each of these dicarboxylic acids can be used alone or in combination with others.

For the purpose of controlling melting characteristics, a branching component and/or a cross-linking component may be contained.

Examples of the branching component and the cross-linking component include, but are not limited to, polyfunctional aliphatic alcohols such as trimethylolpropane and pentaerythritol, polyfunctional carboxylic acids such as trimellitic acid, and isocyanurate comprising a trimer of hexamethylene diisocyanate.

The toner according to an embodiment of the present invention may further comprise a crystalline polyester resin in addition to the two types of amorphous polyester resins. Introduction of a crystalline polyester resin into toner is a known technique for achieving both low-temperature fixability and heat resistant storage stability at the same time.

Preferably, the crystalline polyester resin has a melting point of from 60° C. to 120° C. for low-temperature fixability. In addition, the crystalline polyester preferably contains less residual monomer and oligomer, and the weight average molecular weight thereof is preferably 10,000 or more. The upper limit of the weight average molecular weight is not limited. However, the upper limit may be about 35,000 in view of ease of manufacturing.

Other Components

The toner according to an embodiment of the present invention may further comprise other components.

Examples of the other components include, but are not limited to, a colorant, a release agent, a charge control agent, and an external additive.

Colorant

The colorant is not particularly limited and may be appropriately selected according to the purpose. Specific examples of the colorant include, but are not limited to, a pigment.

Specific examples of the pigment include, but are not limited to, a black pigment, a yellow pigment, a magenta pigment, and a cyan pigment. Preferably, the toner includes at least one of a yellow pigment, a magenta pigment, and a cyan pigment.

The black pigment is used, for example, for black toner. Specific examples of the black pigment include, but are not limited to, carbon black, copper oxide, manganese dioxide, aniline black, activated carbon, non-magnetic ferrite, magnetite, nigrosine dye, and iron black.

The yellow pigment is used, for example, for yellow toner. Specific examples of the yellow pigment include, but are not limited to, C.I. Pigment Yellow 74, 93, 97, 109, 128, 151, 154, 155, 166, 168, 180, and 185, Naphthol Yellow S, Hansa Yellow (10G, 5G, G), cadmium yellow, yellow iron oxide, yellow ocher, chrome yellow, titanium yellow, and polyazo yellow.

The magenta pigment is used, for example, for magenta toner. Specific examples of the magenta pigment include, but are not limited to, a quinacridone pigment and a monoazo pigment such as C.I. Pigment Red 48:2, 57:1, 58:2, 5, 31, 146, 147, 150, 176, 184, and 269. The monoazo pigment and the quinacridone pigment can be used in combination.

The cyan pigment is used, for example, for cyan toner. Specific examples of the cyan pigment include, but are not limited to, Cu-phthalocyanine pigment, Zn-phthalocyanine pigment, and Al-phthalocyanine pigment.

The content of the colorant is not particularly limited and may be appropriately selected according to the purpose. Preferably, the content of the colorant in 100 parts by mass of the toner is in the range of from 1 to 15 parts by mass, more preferably from 3 to 10 parts by mass. When the content is less than 1 part by mass, the coloring power of the toner may decrease. When the content exceeds 15 parts by mass, the colorant may be poorly dispersed in the toner, causing deterioration of the coloring power and electric properties of the toner.

The colorant can be combined with a resin to be used as a master batch. Specific examples of the resin to be used for the master batch include, but are not limited to, polymers of styrene or a derivative thereof (e.g., polystyrene, poly-p-chlorostyrene, polyvinyl toluene), styrene-based copolymers (e.g., styrene-p-chlorostyrene copolymer, styrene-propylene copolymer, styrene-vinyl toluene copolymer, styrene-vinyl naphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl-α-chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, styrene-maleate copolymer), polymethyl methacrylate, polybutyl methacrylate, polyvinyl chloride, polyvinyl acetate, polyethylene, polypropylene, polyester, epoxy resin, epoxy polyol resin, polyurethane, polyamide, polyvinyl butyral, polyacrylic acid resin, rosin, modified rosin, terpene resin, aliphatic or alicyclic hydrocarbon resin, aromatic petroleum resin, chlorinated paraffin, and paraffin wax. Each of these materials can be used alone or in combination with others.

The master batch can be obtained by mixing and kneading the resin and the colorant while applying a high shearing force thereto. To increase the interaction between the colorant and the resin, an organic solvent may be used. More specifically, the maser batch can be obtained by a method called flushing in which an aqueous paste of the colorant is mixed and kneaded with the resin and the organic solvent so that the colorant is transferred to the resin side, followed by removal of the organic solvent and moisture. This method is advantageous in that the resulting wet cake of the colorant can be used as it is without being dried. Preferably, the mixing and kneading is performed by a high shearing dispersing device such as a three roll mill.

Preferably, the colorant (especially a pigment) is present inside the toner. More preferably, the colorant is dispersed inside the toner. In addition, it is preferable that the colorant (especially a pigment) is not present at the surface of the toner.

Release Agent

The release agent is not particularly limited and may be appropriately selected depending on the purpose. Specific examples of the release agent include, but are not limited to, a carbonyl-group-containing wax, a polyolefin wax, and a long-chain hydrocarbon wax. Each of these materials can be used alone or in combination with others. Among these waxes, a carbonyl-group-containing wax is preferable.

Specific examples of the carbonyl-group-containing wax include, but are not limited to, polyalkanoic acid ester, polyalkanol ester, polyalkanoic acid amide, polyalkyl amide, and dialkyl ketone.

Specific examples of the polyalkanoic acid ester include, but are not limited to, carnauba wax, montan wax, trimethylolpropane tribehenate, pentaerythritol tetrabehenate, pentaerythritol diacetate dibehenate, glycerin tribehenate, and 1,18-octadecanediol distearate.

Specific examples of the polyalkanol ester include, but are not limited to, tristearyl trimellitate and distearyl maleate.

Specific examples of the polyalkanoic acid amide include, but are not limited to, dibehenylamide.

Specific examples of the polyalkyl amide include, but are not limited to, trimellitic acid tristearylamide.

Specific examples of the dialkyl ketone include, but are not limited to, distearyl ketone.

Among these carbonyl-group-containing waxes, polyalkanoic acid ester is preferable.

Specific examples of the polyolefin wax include, but are not limited to, polyethylene wax and propylene wax.

Specific examples of the long-chain hydrocarbon wax include, but are not limited to, paraffin wax and SASOL wax.

The melting point of the release agent is not particularly limited and may be appropriately selected according to the purpose, but is preferably from 50° C. to 100° C. and more preferably from 60° C. to 90° C. When the melting point is less than 50° C., heat-resistant storage stability of the toner may be adversely affected. When the melting point is in excess of 100° C., the toner may easily cause cold offset when the toner is fixed at a low temperature.

The melting point of the release agent can be measured by a differential scanning calorimeter (TA-60WS and DSC-60 available from Shimadzu Corporation) as follows.

First, about 5.0 mg of the release agent is put in an aluminum sample container. The container is put on a holder unit and set in an electric furnace. In nitrogen atmosphere, the sample is heated from 0° C. to 150° C. at a temperature rising rate of 10° C./min, cooled from 150° C. to 0° C. at a temperature falling rate of 10° C./min, and reheated to 150° C. at a temperature rising rate of 10° C./min, thus obtaining a DSC curve. The DSC curve is analyzed with analysis program installed in DSC-60 to determine a temperature at which the maximum peak of melting heat is observed in the second heating, and this temperature is identified as the melting point.

Preferably, the melt viscosity of the release agent is from 5 to 100 mPa·sec, more preferably from 5 to 50 mPa·sec, and most preferably from 5 to 20 mPa·sec, at 100° C. When the melt viscosity is less than 5 mPa·sec, releasability may deteriorate. When the melt viscosity is greater than 100 mPa·sec, hot offset resistance and releasability at low temperatures may deteriorate.

The content of the release agent is not particularly limited and may be appropriately selected depending on the purpose. Preferably, the content of the release agent in 100 parts by mass of the toner is in the range of from 1 to 20 parts by mass, more preferably from 3 to 10 parts by mass. When the content is less than 1 part by mass, hot offset resistance may deteriorate. When the content exceeds 20 parts by mass, heat-resistant storage stability, chargeability, transferability, and resistance to stress may deteriorate.

Charge Control Agent

Specific examples of usable charge control agents include, but are not limited to, nigrosine dyes, triphenylmethane dyes, chromium-containing metal complex dyes, chelate pigments of molybdic acid, Rhodamine dyes, alkoxyamines, quaternary ammonium salts (including fluorine-modified quaternary ammonium salts), alkylamides, phosphor and phosphor-containing compounds, tungsten and tungsten-containing compounds, fluorine activators, metal salts of salicylic acid, and metal salts of salicylic acid derivatives. Specific examples of commercially available charge control agents include, but are not limited to, BONTRON® 03 (nigrosine dye), BONTRON® P-51 (quaternary ammonium salt), BONTRON® S-34 (metal-containing azo dye), BONTRON® E-82 (metal complex of oxynaphthoic acid), BONTRON® E-84 (metal complex of salicylic acid), and BONTRON® E-89 (phenolic condensation product), available from Orient Chemical Industries Co., Ltd.; TP-302 and TP-415 (molybdenum complexes of quaternary ammonium salts), available from Hodogaya Chemical Co., Ltd.; and LRA-901 and LR-147 (boron complex), available from Japan Carlit Co., Ltd.

The content of the charge control agent is not particularly limited and may be appropriately selected according to the purpose. Preferably, the content of the charge control agent in 100 parts by mass of the toner is in the range of from 0.01 to 5 parts by mass, more preferably from 0.02 to 2 parts by mass. When the content is less than 0.01 parts by mass, the initial rising of charge and the charge quantity of the toner may be insufficient, adversely affecting the toner image quality. When the content is in excess of 5 parts by mass, chargeability of the toner becomes so large that the electrostatic force between the toner and a developing roller is increased and fluidity of the developer and image density are lowered.

External Additive

The external additive is not particularly limited and may be appropriately selected according to the purpose. Specific examples of the external additive include, but are not limited to, silica, a metal salt of fatty acid, a metal oxide, a hydrophobized titanium oxide, and a fluoropolymer.

Specific examples of the metal salt of fatty acid include, but are not limited to, zinc stearate and aluminum stearate.

Specific examples of the metal oxide include, but are not limited to, titanium oxide, aluminum oxide, tin oxide, and antimony oxide.

Specific examples of commercially-available products of silica include, but are not limited to, R972, R974, RX200, RY200, R202, R805, and R812 (available from Nippon Aerosil Co., Ltd.).

Specific examples of commercially-available products of titanium oxide include, but are not limited to, P-25 (available from Nippon Aerosil Co., Ltd.); STT-30 and STT-65C-S (available from Titan Kogyo, Ltd.); TAF-140 (available from Fuji Titanium Industry Co., Ltd.); and MT-150W, MT-500B, MT-600B, and MT-150A (available from TAYCA Corporation).

Specific examples of commercially available products of hydrophobized titanium oxide include, but are not limited to, T-805 (available from Nippon Aerosil Co., Ltd.); STT-30A and STT-65S-S (available from Titan Kogyo, Ltd.); TAF-500T and TAF-1500T (available from Fuji Titanium Industry Co., Ltd.); MT-100S and MT-100T (available from TAYCA Corporation); and IT-S (available from Ishihara Sangyo Kaisha, Ltd.).

The hydrophobizing treatment can be performed by treating hydrophilic particles with a silane coupling agent such as methyl trimethoxysilane, methyl triethoxysilane, and octyl trimethoxysilane.

The content of the external additive is not particularly limited and may be appropriately selected according to the purpose. Preferably, the content of the external additive in 100 parts by mass of the toner is in the range of from 0.1 to 5 parts by mass, more preferably from 0.3 to 3 parts by mass.

The average particle diameter of the primary particles of the external additive is not particularly limited and may be appropriately selected according to the purpose, but is preferably 100 nm or less, and more preferably from 3 to 70 nm. When the average particle diameter falls below 3 nm, the external additive may be embedded in the toner and its function may not be effectively exhibited. When the average particle diameter exceeds 100 nm, the external additive may unevenly make flaws on the surface of the photoconductor.

Here, the procedures and conditions of various measurements are described below.

Example of GPC Measurement

A gel permeation chromatography (GPC) measurement can be performed by a gel permeation chromatographic instrument (such as HLC-8220 GPC available from Tohsoh Corporation) preferably equipped with a fraction collector.

As columns, TSKgel SuperHZM-H 15 cm in 3-tandem (available from Tosoh Corporation) may be used. A resin to be measured is dissolved in tetrahydrofuran (THF containing a stabilizer, available from Wako Pure Chemical Industries, Ltd.) to prepare a 0.15 mass % solution thereof. The solution is filtered with a 0.2-μm filter and the filtrate is used as a sample in succeeding procedures. Next, 100 μL of the sample (i.e., THF solution of the resin) is injected into the instrument and subjected to a measurement in an environment having a temperature of 40° C. under a flow rate of 0.35 mL/min.

A molecular weight is determined with reference to a calibration curve compiled from monodisperse polystyrene standard samples. As the monodisperse polystyrene standard samples, Showdex STANDARD series available from Showa Denko K.K. and toluene can be used. Three types of THF solutions A, B, and C of monodisperse polystyrene standard samples having the following compositions are prepared and subjected to a measurement under the above-described conditions. A calibration curve is compiled with light-scattering molecular weights of the monodisperse polystyrene standard samples that are represented by retention time for the peaks.

Solution A: 2.5 mg of S-7450, 2.5 mg of S-678, 2.5 mg of S-465, 2.5 mg of S-2.90, and 50 mL of THF Solution B: 2.5 mg of S-3730, 2.5 mg of S-257, 2.5 mg of S-19.8, 2.5 mg of S-0.580, and 50 mL of THF Solution C: 2.5 mg of S-1470, 2.5 mg of S-112, 2.5 mg of S-6.93, 2.5 mg of toluene, and 50 mL of THF As the detector, a refraction index (RI) detector may be used, and an ultraviolet (UV) detector that is more sensitive may be used when fractionation is conducted.

AFM in Tapping Mode

In the present disclosure, a phase image is obtained with an atomic force microscope (AFM) in tapping mode.

The tapping mode in AFM is a method described in Surface Science Letter, 290, 668 (1993). In this method, the surface profile of a sample is measured while vibrating a cantilever, as described in, for example, Polymer, 35, 5778 (1994) and Macromolecules, 28, 6773, (1995). Due to the viscoelastic property of the sample surface, a phase difference generates between a drive for vibrating the cantilever and the actual vibration. By mapping such phase differences, a phase image is obtained. Soft portions are observed to have a large phase delay. Hard portions are observed to have a small phase delay.

Preferably, in the toner according to an embodiment of the present invention, soft portions having a large phase difference and hard portions having a small phase difference are finely dispersed. More preferably, the second phase-contrast portions consisting of hard portions having a small phase difference and the first phase-contrast portions consisting of soft portions having a large phase difference are finely dispersed in the toner with the second phase-contrast portions constituting the outer phase and the first phase-contrast portions forming constituting the inner phase.

A sample for obtaining the phase image can be prepared by, for example, cutting the toner into a section with an ultramicrotome ULTRACUT UCT available from Leica under the following conditions.

Cutting thickness: 60 nm

Cutting speed: 0.4 mm/sec

Knife: Diamond knife (Ultra Sonic 35°)

The AFM phase image can be obtained with, for example, an instrument MFP-3D available from Asylum Research and a cantilever OMCL-AC240TS-C3 under the following conditions.

Target amplitude: 0.5 V

Target percent: −5%

Amplitude setpoint: 315 mV

Scan rate: 1 Hz

Scan points: 256×256

Scan angle: 0°

Figure 3:
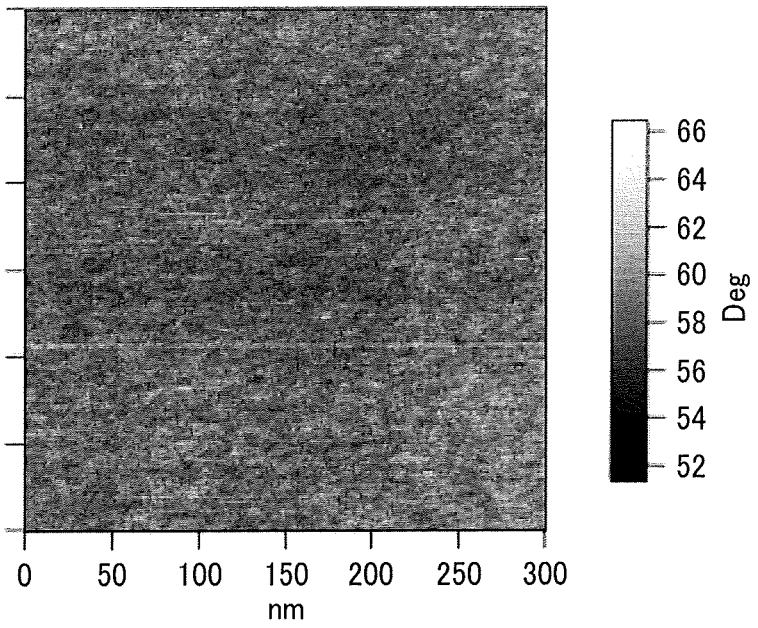
FIG. 3 is an example of an image with an ultrafine particle diameter, which is difficult to determine whether the image is image noise or a phase image.

The average of the maximum Feret diameters of the first phase-contrast portions (i.e., soft units) is measured by first obtaining a phase image with an AFM in tapping mode and then obtaining a binarized image by binarizing the phase image with an intermediate value between the maximum and minimum phase difference values in the phase image. The phase image is photographed in such a way that small-phase-difference portions are represented by a dark color while large-phase-difference portions are represented by a light color. The binarized image is then obtained by binarizing the phase image using an intermediate value between the maximum and minimum phase difference values in the phase image as the boundary. The binarization processing is performed for 10 randomly-selected 300-nm-square portions in the phase image of the toner. In each of the 10 selected portions in the phase image, the Feret diameters of the first phase-contrast portions when in a dot-like structure, or the minimum widths of the first phase-contrast portions when in a periodic structure, are measured and the measured values are averaged. In a case in which the obtained image is an image with an ultrafine particle diameter (as illustrated in FIG. 3) that is clearly determined to be image noise or is indistinguishable from image noise, such an image is excluded from the calculation of the average value. More specifically, among the observed first phase-contrast portions, those having an area one-hundredth or less of the area of the first phase-contrast portion having the largest maximum Feret diameter in the same phase image are excluded from the calculation of the average value. The maximum Feret diameter is defined as the greatest distance between two parallel lines sandwiching each first phase-contrast portion.

Figure 2:
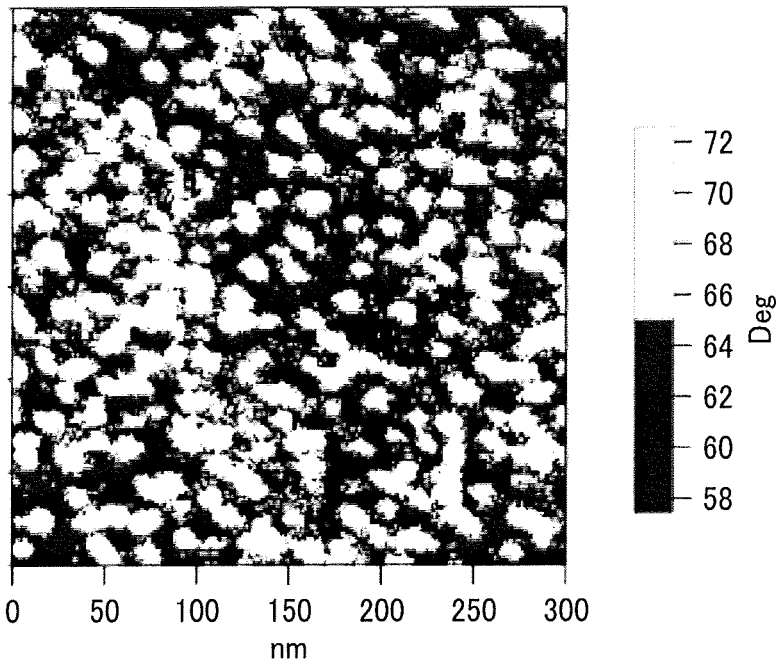
FIG. 2 is a binarized image obtained by binarizing the phase image of FIG. 1.

For reference, FIG. 1 is an example of a phase image of a toner. FIG. 2 is a binarized image obtained by binarizing the phase image of FIG. 1. Referring to FIG. 2, the bright regions represent the first phase-contrast portions having a large phase difference and the dark regions represent the second phase-contrast portions having a small phase difference.

Glass Transition Temperature (Tg)

Glass transition temperature of the toner is measured as follows.

A sample in an amount of 5 mg is put in a simple sealed pan Tzero (available from TA Instruments) and subjected to a measurement by a differential scanning calorimeter (Q2000 available from TA Instruments).

In the measurement, under nitrogen gas flow, the temperature is raised from −60° C. to 150° C. at a rate of 10° C./min in the first temperature rise and kept for 5 minutes, and then cooled to −60° C. at a rate of 10° C./min and kept for 5 minutes.

Next, the temperature is raised at a rate of 10° C./min in the second temperature rise to measure a thermal change. The relation between the amount of heat absorption or heat generation and the temperature is drawn into a graph, and the glass transition temperature (Tg), cold crystallization temperature, melting point, crystallization temperature, etc., are determined in accordance with known methods. In the present disclosure, Tg which is determined from a DSC curve obtained in the first temperature rise by a midpoint method is employed. Here, the midpoint method refers to a method described in the specification of JIS (Japanese Industrial Standard) K7121-1987 entitled "Testing Methods for Transition Temperatures of Plastics".

Method for Producing Toner

The method for producing the toner is not particularly limited and may be appropriately selected according to the purpose. Examples thereof include, but are not limited to, a wet granulation method and a pulverization method. Specific examples of the wet granulation method include, but are not limited to, a dissolution suspension method and an emulsion aggregation method. The dissolution suspension method and the emulsion aggregation method are preferable because these methods do not have the process of kneading the binder resin, which is free from the problem of molecular cut caused by kneading or the difficulty in uniformly kneading of high-molecular-weight resin with low-molecular-weight resin. The dissolution suspension method is more preferable for uniformity of the binder resin in the toner particles.

The toner can also be produced by a method of producing particles described in Japanese Patent No. 4531076 (corresponding to JP-2008-287088-A). This method includes the processes of dissolving toner constituents in a liquid or supercritical carbon dioxide and thereafter removing the liquid or supercritical carbon dioxide to obtain toner particles.

Dissolution Suspension Method

The dissolution suspension method includes a process of preparing a toner material phase, a process of preparing an aqueous medium phase, a process of preparing an emulsion or liquid dispersion, and a process of removing an organic solvent, and optionally includes other processes as necessary.

Process of Preparing Toner Material Phase (Oil Phase)

The process of preparing a toner material phase is not particularly limited and can be appropriately selected according to the purpose as long as toner materials including at least the binder resin and optionally the colorant and the release agent are dissolved or dispersed in an organic solvent to prepare a solution or liquid dispersion of the toner materials (hereinafter "toner material phase" or "oil phase").

The organic solvent is not particularly limited and may be appropriately selected according to the purpose. Preferably, the organic solvent is a volatile solvent having a boiling point of less than 150° C., which is easily removable.

Specific examples of the organic solvent include, but are not limited to, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. Among these solvents, ethyl acetate, toluene, xylene, benzene, methylene chloride, 1,2-dichloroethane, chloroform, and carbon tetraoxide are preferable, and ethyl acetate is most preferable.

Each of these materials can be used alone or in combination with others.

The amount of the organic solvent to be used is not particularly limited and may be appropriately selected according to the purpose, but is preferably from 0 to 300 parts by mass, more preferably from 0 to 100 parts by mass, and most preferably from 25 to 70 parts by mass, based on 100 parts by mass of the toner materials.

Process of Preparing Aqueous Medium Phase (Aqueous Phase)

The process of preparing an aqueous medium phase is not particularly limited and can be appropriately selected depending on the purpose as long as an aqueous medium phase is prepared. In this process, it is preferable that an aqueous medium phase is prepared by containing fine resin particles in an aqueous medium.

The aqueous medium is not particularly limited and may be appropriately selected according to the purpose. Specific examples of the aqueous medium include, but are not limited to, water, a water-miscible solvent, and a mixture thereof. Among these aqueous media, water is particularly preferable.

Specific examples of the water-miscible solvent include, but are not limited to, an alcohol, dimethylformamide, tetrahydrofuran, a cellosolve, and a lower ketone.

Specific examples of the alcohol include, but are not limited to, methanol, isopropanol, and ethylene glycol.

Specific examples of the lower ketone include, but are not limited to, acetone and methyl ethyl ketone.

Each of these materials can be used alone or in combination with others.

The aqueous medium phase may be prepared by dispersing fine resin particles in the aqueous medium in the presence of a surfactant. The reason for adding the surfactant and the fine resin particles in the aqueous medium is to improve dispersibility of the toner materials.

The amount of each of the surfactant and the fine resin particles to be added to the aqueous medium is not particularly limited and may be appropriately selected according to the purpose, but is preferably from 0.5% to 10% by mass based on the aqueous medium.

The surfactant is not particularly limited and may be appropriately selected according to the purpose. Specific examples of the surfactant include, but are not limited to, an anionic surfactant, a cationic surfactant, and an ampholytic surfactant.

Specific examples of the anionic surfactant include, but are not limited to, fatty acid salt, alkyl sulfate, alkyl aryl sulfonate, alkyl diaryl ether disulfonate, dialkyl sulfosuccinate, alkyl phosphate, naphthalene sulfonic acid formalin condensate, polyoxyethylene alkyl phosphate, and glyceryl borate fatty acid ester.

The fine resin particles are not limited in the type of resin as long as an aqueous dispersion thereof is obtainable. Usable resins include both thermoplastic resins and thermosetting resins. Specific examples of resins usable for the fine resin particles include, but are not limited to, vinyl resin, polyurethane resin, epoxy resin, polyester resin, polyamide resin, polyimide resin, silicone resin, phenol resin, melamine resin, urea resin, aniline resin, ionomer resin, and polycarbonate resin. Each of these materials can be used alone or in combination with others.

Among these resins, vinyl resin, polyurethane resin, epoxy resin, polyester resin, and combinations thereof are preferable because an aqueous dispersion of fine spherical particles thereof is easily obtainable.

Specific examples of the vinyl resin include, but are not limited to, homopolymers and copolymers of vinyl monomers, such as styrene-acrylate copolymer, styrene-methacrylate copolymer, styrene-butadiene copolymer, acrylic acid-acrylate copolymer, methacrylic acid-acrylate copolymer, styrene-acrylonitrile copolymer, styrene-maleic anhydride copolymer, styrene-acrylic acid copolymer, and styrene-methacrylic acid copolymer.

The average particle diameter of the fine resin particles is not particularly limited and may be appropriately selected according to the purpose, but is preferably from 5 to 200 nm, and more preferably from 20 to 300 nm.

In preparing the aqueous medium phase, cellulose can be used as a dispersant. Specific examples of the cellulose include, but are not limited to, methyl cellulose, hydroxyethyl cellulose, hydroxypropyl cellulose, and carboxymethylcellulose sodium.

Process of Preparing Emulsion or Liquid Dispersion

The process of preparing an emulsion or liquid dispersion is not particularly limited and can be appropriately selected depending on the purpose as long as the solution or liquid dispersion of the toner materials (i.e., the toner material phase) is emulsified or dispersed in the aqueous medium phase to prepare an emulsion or liquid dispersion.

The process of emulsification or dispersion is not particularly limited and can be appropriately selected according to the purpose, and may be performed with a known disperser. Specific examples of the disperser include, but are not limited to, a low-speed shearing disperser and a high-speed shearing disperser.

The amount of the aqueous medium phase to be used is not particularly limited and may be appropriately selected according to the purpose, but is preferably from 50 to 2,000 parts by mass, more preferably from 100 to 1,000 parts by mass, based on 100 parts by mass of the toner material phase. When the amount to be used is less than 50 parts by mass, the dispersion state of the toner material phase is poor and toner particles having a desired particle size may not be obtained. When the amount to be used exceeds 2,000 parts by mass, it is not economical.

Process of Removing Organic Solvent

The process of removing an organic solvent is not particularly limited and can be appropriately selected according to the purpose as long as the organic solvent is removed from the emulsion or liquid dispersion to obtain a solvent-free slurry.

The organic solvent can be removed by (1) gradually heating the whole reaction system to completely evaporate the organic solvent from oil droplets in the emulsion or liquid dispersion or (2) spraying the emulsion or liquid dispersion into a dry atmosphere to completely evaporate the organic solvent from oil droplets in the emulsion or liquid dispersion. Upon removal of the organic solvent, toner particles are formed.

Other Processes

The other processes may include, for example, a washing process and a drying process.

Washing Process

The washing process is not particularly limited and can be appropriately selected according to the purpose as long as the solvent-free slurry is washed with water after the process of removing the organic solvent. Specific examples of the water include, but are not limited to, ion-exchange water.

Drying Process

The drying process is not particularly limited and can be appropriately selected according to the purpose as long as toner particles obtained in the washing process are dried.

Pulverization Method

The pulverization method is a method for producing mother toner particles through the processes of melt-kneading toner materials including at least the binder resin, pulverizing the kneaded product, and classifying the pulverized product.

In the melt-kneading process, a mixture of the toner materials is melt-kneaded by a melt-kneader. Specific examples of the melt-kneader include, but are not limited to, a single-axis or double-axis continuous kneader and a batch kneader using roll mill. Specific examples of commercially available products of the melt-kneader include, but are not limited to, TWIN SCREW EXTRUDER KTK from Kobe Steel, Ltd., TWIN SCREW COMPOUNDER TEM from Toshiba Machine Co., Ltd., MIRACLE K.C.K from Asada Iron Works Co., Ltd., TWIN SCREW EXTRUDER PCM from Ikegai Co., Ltd., and KOKNEADER from Buss Corporation. Preferably, the melt-kneading process is performed under an appropriate condition such that the molecular chains of the binder resin are not cut. Specifically, the melt-kneading temperature is determined with reference to the softening point of the binder resin. When the melt-kneading temperature is excessively higher than the softening point, molecular chains may be significantly cut. When the melt-kneading temperature is excessively lower than the softening point, toner components may not be well dispersed therein.

In the pulverizing process, the melt-kneaded product is pulverized. Preferably, the kneaded product is first pulverized into coarse particles, and the coarse particles are then pulverized into fine particles. Suitable pulverization methods include a method which collides particles with a collision board in a jet stream; a method which collides particles with each other in a jet stream; and a method which pulverizes particles in a narrow gap formed between a rotor mechanically rotating and a stator.

In the classifying process, the pulverized product is adjusted to have a predetermined particle diameter. In the classifying process, ultrafine particles are removed by means of cyclone separator, decantation, or centrifugal separator.

Developer and Developer for Replenishment

A developer according to an embodiment of the present invention and a developer for replenishment according to an embodiment of the present invention each contain the toner according to an embodiment of the present invention. The developer may be either a one-component developer or a two-component developer in which the toner is mixed a carrier. To be used for a high-speed printer corresponding to a recent improvement in information processing speed, the two-component developer is more preferable for extending the lifespan of the printer.

In the case of one-component developer, even when toner supply and toner consumption are repeatedly performed, the particle diameter of the toner fluctuates very little. In addition, neither toner filming on a developing roller nor toner fusing to a layer thickness regulating member (e.g., a blade for forming a thin layer of toner) occurs. Thus, even when the developer is used (stirred) in a developing device for a long period of time, developability and image quality remain good and stable.

In the case of two-component developer, even when toner supply and toner consumption are repeatedly performed for a long period of time, the particle diameter of the toner fluctuates very little. Thus, even when the developer is stirred in a developing device for a long period of time, developability and image quality remain good and stable.

Carrier

The carrier is not particularly limited and may be appropriately selected according to the purpose. Preferably, the carrier comprises a core material and a resin layer covering the core material.

Core Material

The core material is not particularly limited and may be appropriately selected according to the purpose. Specific examples of the core material include, but are not limited to, ferrite, magnetite, iron, and nickel. With respect to ferrite, considering the attention to environmental applicability that is remarkably increasing recently, manganese ferrite, manganese-magnesium ferrite, manganese-strontium ferrite, manganese-magnesium-strontium ferrite, and lithium ferrite are more preferred rather than copper-zinc ferrite that has been conventionally used.

Resin Layer

Specific examples of resins usable for the resin layer include, but are not limited to, amino resin, polyvinyl resin, polystyrene resin, halogenated olefin resin, polyester resin, polycarbonate resin, polyethylene resin, polyvinyl fluoride resin, polyvinylidene fluoride resin, polytrifluoroethylene resin, polyhexafluoropropylene resin, copolymer of vinylidene fluoride with an acrylic monomer, copolymer of vinylidene fluoride with vinyl fluoride, fluoroterpolymer (e.g., terpolymer of tetrafluoroethylene, vinylidene fluoride, and non-fluoride monomer), and silicone resin. Each of these materials can be used alone or in combination with others.

Specific examples of the silicone resin include, but are not limited to, a straight silicone resin consisting of organosiloxane bonds only; and a modified silicone resin modified with alkyd resin, polyester resin, epoxy resin, acrylic resin, or urethane resin.

Commercially-available products of the silicone resin can also be used.

Specific examples of the straight silicone resin include, but are not limited to, KR271, KR255, and KR152 (available from Shin-Etsu Chemical Co., Ltd.); and SR2400, SR2406, and SR2410 (available from Dow Corning Toray Co., Ltd.).

Specific examples of the modified silicone resin include, but are not limited to, KR-206 (alkyd-modified silicone resin), KR-5208 (acrylic-modified silicone resin), ES-1001N (epoxy-modified silicone resin), and KR-305 (urethane-modified silicone resin), each available from Shin-Etsu Chemical Co., Ltd.); and SR2115 (epoxy-modified silicone resin) and SR2110 (alkyd-modified silicone resin), each available from Dow Corning Toray Co., Ltd.).

The silicone resin may be used alone or in combination with a cross-linkable component and/or a charge amount controlling agent.

Preferably, the content of components forming the resin layer in the carrier is from 0.01% to 5.0% by mass. When the content is less than 0.01% by mass, it may be impossible to form a uniform resin layer on the surface of the core material. When the content is in excess of 5.0% by mass, the resin layer becomes so thick that coalescence of carrier particles occurs and uniform carrier particles may not be obtained.

The content of the toner in the two-component developer is not particularly limited and may be appropriately selected according to the purpose, but is preferably from 2.0 to 12.0 parts by mass, more preferably from 2.5 to 10.0 parts by mass, based on 100 parts by mass of the carrier.

Preferably, in the two-component developer for replenishment, 2 to 50 parts by mass of the toner are blended with 1 part by mass of the carrier.

In the present disclosure, a toner storage unit refers to a unit that has a function of storing toner and that is storing the above toner. The toner storage unit may be in the form of, for example, a toner storage container, a developing device, or a process cartridge.

In the present disclosure, the toner storage container refers to a container storing the toner.

The developing device refers to a device storing the toner and having a developing unit configured to develop an electrostatic latent image into a toner image with the toner.

The process cartridge refers to a combined body of an image bearer with a developing unit storing the toner, detachably mountable on an image forming apparatus. The process cartridge may further include at least one of a charger, an irradiator, and a cleaner.

In the following, a developer storage container that accommodates a developer including the toner will be described.

Developer Storage Container

A developer storage container according to an embodiment of the present invention includes a container and the developer according to an embodiment of the present invention contained in the container. The container is not particularly limited and can be appropriately selected from known containers. Examples thereof include, but are not limited to, a container including a container body and a cap.

The container body is not limited in size, shape, structure, and material. Preferably, the container body has a cylindrical shape. Preferably, on the inner circumferential surface of the container body, projections and recesses are formed in a spiral manner, so that the developer can move to the discharge port side as the container body rotates. More preferably, part or all of the projections and recesses formed in a spiral manner have an accordion function. The container body is not particularly limited in material but is preferably made of a resin material having good dimension accuracy, such as polyester resin, polyethylene resin, polypropylene resin, polystyrene resin, polyvinyl chloride resin, polyacrylic acid, polycarbonate resin, ABS resin, and polyacetal resin.

The developer storage container is easy to preserve, transport, and handle. Therefore, the developer storage container is detachably mountable on a process cartridge or an image forming apparatus (to be described later) to supply the developer thereto.

Image Forming Apparatus and Image Forming Method

An image forming apparatus according to an embodiment of the present invention includes: an electrostatic latent image bearer (hereinafter maybe "photoconductor"); an electrostatic latent image forming device configured to form an electrostatic latent image on the electrostatic latent image bearer; and a developing device containing the toner according to an embodiment of the present invention, configured to develop the electrostatic latent image formed on the electrostatic latent image bearer with the toner into a toner image. The image forming apparatus may optionally include other devices as necessary.

An image forming method according to an embodiment of the present invention includes: an electrostatic latent image forming process for forming an electrostatic latent image on an electrostatic latent image bearer; and a developing process for developing the electrostatic latent image formed on the electrostatic latent image bearer with the toner according to an embodiment of the present invention into a toner image. The image forming apparatus may optionally include other processes as necessary.

The image forming method is preferably performed by the image forming apparatus. The electrostatic latent image forming process is preferably performed by the electrostatic latent image forming device. The developing process is preferably performed by the developing device. Other optional processes are preferably performed by other optional devices.

Electrostatic Latent Image Bearer

The electrostatic latent image bearer is not limited in material, structure, and size. Specific examples of usable materials include, but are not limited to, inorganic photoconductors such as amorphous silicon and selenium, and organic photoconductors such as polysilane and phthalopolymethine. Among these materials, amorphous silicon is preferable for long operating life.

An amorphous silicon photoconductor can be prepared by, for example, heating a substrate to 50° C. to 400° C. and forming a photoconductive layer comprising amorphous silicon on the substrate by a film formation process such as vacuum evaporation, sputtering, ion plating, thermal CVD (Chemical Vapor Deposition), optical CVD, and plasma CVD. In particular, plasma CVD, which forms an amorphous silicon film on the substrate by decomposing a raw material gas by direct-current, high-frequency, or microwave glow discharge, is preferable.

The electrostatic latent image bearer is not limited in shape but preferably in the form of a cylinder. The outer diameter of the electrostatic latent image bearer in the form of a cylinder is not particularly limited and may be appropriately selected according to the purpose, but is preferably from 3 to 100 mm, more preferably from 5 to 50 mm, and most preferably from 10 to 30 mm.

Electrostatic Latent Image Forming Device and Electrostatic Latent Image Forming Process The electrostatic latent image forming device is not particularly limited and can be appropriately selected according to the purpose as long as it is capable of forming an electrostatic latent image on the electrostatic latent image bearer. For example, the electrostatic latent image forming device may include a charger to uniformly charge a surface of the electrostatic latent image bearer and an irradiator to irradiate the surface of the electrostatic latent image bearer with light containing image information.

The electrostatic latent image forming process is not particularly limited and can be appropriately selected according to the purpose as long as an electrostatic latent image is formed on the electrostatic latent image bearer. For example, the electrostatic latent image forming process may include charging a surface of the electrostatic latent image bearing member and irradiating the charged surface with light containing image information. The electrostatic latent image forming process can be performed by the electrostatic latent image forming device.

Charger and Charging Process

The charger is not particularly limited and may be appropriately selected according to the purpose. Specific examples of the charger include, but are not limited to, contact chargers equipped with a conductive or semiconductive roller, a brush, a film, or a rubber blade, and non-contact chargers employing corona discharge such as corotron and scorotron.

The charging process may include applying a voltage to a surface of the electrostatic latent image bearer by the charger.

The shape of the charger is determined in accordance with the specification or configuration of the image forming apparatus, and may be in the form of a roller, a magnetic brush, a fur brush, etc.

When the charger is in the form of a magnetic brush, the magnetic brush may comprise ferrite particles (e.g., Zn—Cu ferrite) as charging members, a non-magnetic conductive sleeve for supporting the ferrite particles, and a magnet roll contained therein.

When the charger is in the form of a fur brush, the fur brush may be made of a conductive-treated fur treated with carbon, copper sulfide, a metal, or a metal oxide. The conductive-treated fur is wound around or attached to a conductive-treated cored bar treated with a metal or the like to form a fur brush.

The charger is not limited to the contact charger. However, the contact charger is preferable because the amount of by-product ozone is small.

Irradiator and Irradiation Process

The irradiator is not particularly limited and may be appropriately selected depending on the purpose as long as it is capable of emitting light containing image information to the surface of the electrostatic latent image bearer charged by the charger. Specific examples of the irradiator include, but are not limited to, various irradiators of radiation optical system type, rod lens array type, laser optical type, and liquid crystal shutter optical type.

The light source used for the irradiator is not particularly limited and may be appropriately selected according to the purpose. Specific examples thereof include, but are not limited to, luminescent matters such as fluorescent lamp, tungsten lamp, halogen lamp, mercury lamp, sodium lamp, light emitting diode (LED), laser diode (LD), and electroluminescence (EL).

For the purpose of emitting light having a desired wavelength only, any type of filter can be used, such as sharp cut filter, band pass filter, near infrared cut filter, dichroic filter, interference filter, and color-temperature conversion filter.

The irradiation process may include irradiating the surface of the electrostatic latent image bearer with light containing image information emitted from the irradiator.

The irradiation can also be conducted by irradiating the back surface of the electrostatic latent image bearer with light containing image information.

Developing Device and Developing Process

The developing device is not particularly limited and can be appropriately selected according to the purpose as long as it is capable of storing the toner and developing the electrostatic latent image formed on the electrostatic latent image bearer with the toner into a toner image.

The developing process is not particularly limited and can be appropriately selected according to the purpose as long as the electrostatic latent image formed on the electrostatic latent image bearer is developed with the toner into a toner image. The developing process can be performed by the developing device.

The developing device may employ either a dry developing method or a wet developing method. The developing device may be either a single-color developing device or a multi-color developing device.

Preferably, the developing device includes a stirrer to frictionally stir and charge the toner, a magnetic field generator fixed inside the developing device, and a rotatable developer bearer to bear a developer containing the toner on its surface.

In the developing device, the toner particles and the carrier particles are mixed and agitated. The toner particles are charged by friction and retained on the surface of the rotating magnet roller, thus forming magnetic brush. The magnet roller is disposed proximity to the electrostatic latent image bearer, so that a part of the toner particles composing the magnetic brush formed on the surface of the magnet roller are moved to the surface of the electrostatic latent image bearer by electric attractive force. As a result, the electrostatic latent image is developed with the toner particles and a toner image is formed with the toner particles on the surface of the electrostatic latent image bearer.

Other Devices and Other Processes Examples of the other optional devices include, but are not limited to, a transfer device, a fixing device, a cleaner, a neutralizer, a recycler, and a controller.

Examples of the other optional processes include, but are not limited to, a transfer process, a fixing process, a cleaning process, a neutralization process, a recycle process, and a control process.

Transfer Device and Transfer Process

The transfer device is not particularly limited and can be appropriately selected according to the purpose as long as it is capable of transferring the toner image onto a recording medium. Preferably, the transfer device includes a primary transfer device configured to transfer the toner image onto an intermediate transfer medium to form a composite transfer image, and a secondary transfer device configured to transfer the composite transfer image onto a recording medium.

The transfer process is not particularly limited and can be appropriately selected according to the purpose as long as the toner image is transferred onto a recording medium. Preferably, the transfer process includes primarily transferring the toner image onto an intermediate transfer medium and secondarily transferring the toner image onto a recording medium.

In the transfer process, the toner image may be transferred by charging the electrostatic latent image bearer by a transfer charger. The transfer process can be performed by the transfer device.

When the image to be secondarily transferred onto the recording medium is a color image formed of multiple toners having different colors, each color toner is sequentially superimposed on one another on the intermediate transfer medium to form a composite image thereon and then the composite image on the intermediate transfer medium is secondarily transferred onto the recording medium.

The intermediate transfer medium is not particularly limited and can be appropriately selected from among known transfer members according to the purpose. Specific preferred examples of the intermediate transfer medium include, but are not limited to, a transfer belt.

The transfer device (including the primary transfer device and the secondary transfer device) preferably includes a transferrer configured to separate the toner image formed on the electrostatic latent image bearer to the recording medium side by charging. Specific examples of the transferrer include, but are not limited to, a corona transferrer utilizing corona discharge, a transfer belt, a transfer roller, a pressure transfer roller, and an adhesive transferrer.

Although the recording medium is typically plain paper, it is not particularly limited and can be appropriately selected according to the purpose as long as it is capable of transferring an unfixed image developed. For example, a PET (polyethylene terephthalate) base for use in overhead projector (OHP) can be used as the recording medium.

Fixing Device and Fixing Process

The fixing device is not particularly limited and can be appropriately selected according to the purpose as long as it is capable of fixing the transferred toner image on the recording medium. Preferably, the fixing device includes a heat-pressure member. Specific examples of the heat-pressure member include, but are not limited to: a combination of a heat roller and a pressure roller; and a combination of a heat roller, a pressure roller, and an endless belt.

The fixing process is not particularly limited and can be appropriately selected according to the purpose as long as the toner image transferred onto the recording medium is fixed thereon. The fixing process may be performed either every time each color toner is transferred onto the recording medium or at once after all color toners are superimposed on one another.

The fixing process can be performed by the fixing device. The heating temperature of the heat-pressure member is preferably from 80 to 200° C.

The fixing device may be used together with or replaced with an optical fixer according to the purpose.

In the fixing process, the fixing pressure is not particularly limited and may be appropriately selected according to the purpose, but is preferably from 10 to 80 N/cm$^2$.

Cleaner and Cleaning Process

The cleaner is not particularly limited and can be appropriately selected according to the purpose as long as it is capable of removing residual toner particles remaining on the electrostatic latent image bearer. Specific examples of the cleaner include, but are not limited to, a magnetic brush cleaner, an electrostatic brush cleaner, a magnetic roller cleaner, a blade cleaner, a brush cleaner, and a web cleaner.

The cleaning process is not particularly limited and can be appropriately selected according to the purpose as long as residual toner particles remaining on the electrostatic latent image bearer are removed. The cleaning process can be performed by the cleaner.

Neutralizer and Neutralization Process

The neutralizer is not particularly limited and can be appropriately selected according to the purpose as long as it is capable of neutralizing the electrostatic latent image bearer by application of a neutralization bias thereto. Specific examples of the neutralizer include, but are not limited to, a neutralization lamp.

The neutralization process is not particularly limited and can be appropriately selected according to the purpose as long as the electrostatic latent image bearer is neutralized by application of a neutralization bias thereto. The neutralization process can be performed by the neutralizer.

Recycler and Recycle Process

The recycler is not particularly limited and can be appropriately selected according to the purpose as long as it is capable of making the developing device recycle the toner removed in the cleaning process. Specific examples of the recycler include, but are not limited to, a conveyer.

The recycle process is not particularly limited and can be appropriately selected according to the purpose as long as the toner particles removed in the cleaning process are recycled by the developing device. The recycle process can be performed by the recycler.

Controller and Control Process

The controller is not particularly limited and can be appropriately selected according to the purpose as long as it is capable of controlling the above-described devices. Specific examples of the controller include, but are not limited to, a sequencer and a computer.

The control process is not particularly limited and can be appropriately selected according to the purpose as long as the above-descried processes are controlled. The control process can be performed by the controller.

An image forming method performed by the image forming apparatus according to an embodiment of the present invention is described below with reference to FIG. 4. An image forming apparatus 100A illustrated in FIG. 4 includes an electrostatic latent image bearer 10, a charging roller 20 serving as the charger, an irradiator 30 serving as the irradiator, a developing device 40 serving as the developing device, an intermediate transfer medium 50, a cleaner 60 serving as the cleaner equipped with a cleaning blade, and a neutralization lamp 70 serving as the neutralizer.

The intermediate transfer medium 50 is in the form of an endless belt and is stretched taut by three rollers 51 disposed inside the loop of the endless belt. The intermediate transfer medium 50 is movable in the direction indicated by arrow in FIG. 4. One or two of the three rollers 51 also function(s) as transfer bias roller(s) for applying a predetermined transfer bias (primary transfer bias) to the intermediate transfer medium 50. In the vicinity of the intermediate transfer medium 50, a cleaner 90 equipped with a cleaning blade is disposed. In the vicinity of the intermediate transfer medium 50, a transfer roller 80, serving as the transfer device, that applies a transfer bias to a transfer sheet 95, serving as a recording medium, for secondarily transferring a toner image thereon is disposed facing the intermediate transfer medium 50. Around the intermediate transfer medium 50, a corona charger 58 that gives charge to the toner image on the intermediate transfer medium 50 is disposed between the contact point of the intermediate transfer medium 50 with the electrostatic latent image bearer 10 and the contact point of the intermediate transfer medium 50 with the transfer sheet 95 relative to the direction of rotation of the intermediate transfer medium 50.

The developing device 40 includes a developing belt 41 serving as the developer bearer; and a black developing unit 45K, a yellow developing unit 45Y, a magenta developing unit 45M, and a cyan developing unit 45C each disposed around the developing belt 41. The black developing unit 45K includes a developer container 42K, a developer supply roller 43K, and a developing roller 44K. The yellow developing unit 45Y includes a developer container 42Y, a developer supply roller 43Y, and a developing roller 44Y. The magenta developing unit 45M includes a developer container 42M, a developer supply roller 43M, and a developing roller 44M. The cyan developing unit 45C includes a developer container 42C, a developer supply roller 43C, and a developing roller 44C. The developing belt 41 is in the form of an endless belt and stretched taut by multiple belt rollers. A part of the developing belt 41 is in contact with the electrostatic latent image bearer 10.

Figure 4:
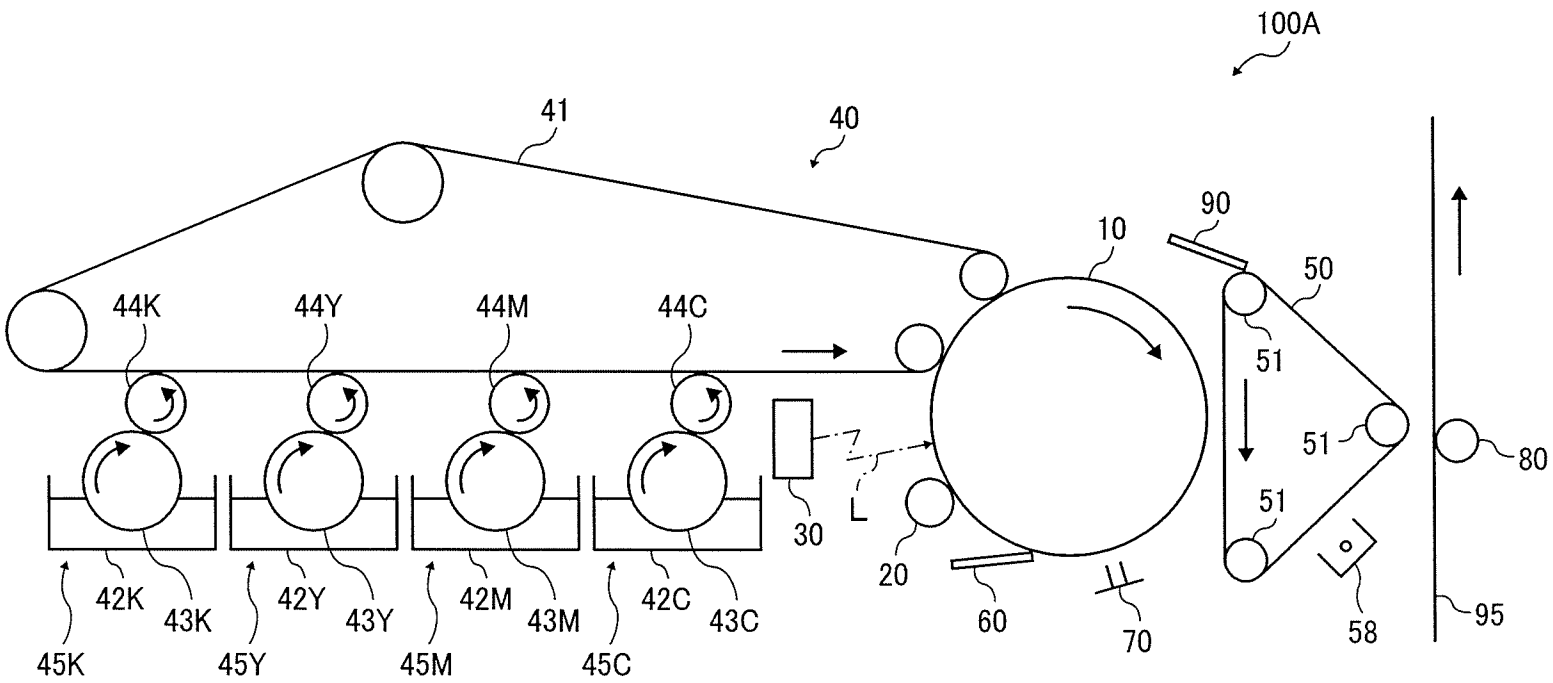
FIG. 4 is a schematic view of an image forming apparatus according to an embodiment of the present invention.

In the image forming apparatus 100A illustrated in FIG. 4, the charging roller 20 uniformly charges the electrostatic latent image bearer 10. The irradiator 30 irradiates the electrostatic latent image bearer 10 with light L containing image information to form an electrostatic latent image thereon. The electrostatic latent image formed on the electrostatic latent image bearer 10 is developed into a toner image with toner supplied from the developing device 40. The toner image is primarily transferred onto the intermediate transfer medium 50 by a voltage applied from the roller 51 and secondarily transferred onto the transfer sheet 95. Thus, a transfer image is formed on the transfer sheet 95. Residual toner particles remaining on the electrostatic latent image bearer 10 are removed by the cleaner 60. The charge of the electrostatic latent image bearer 10 is once eliminated by the neutralization lamp 70.

Figure 5:
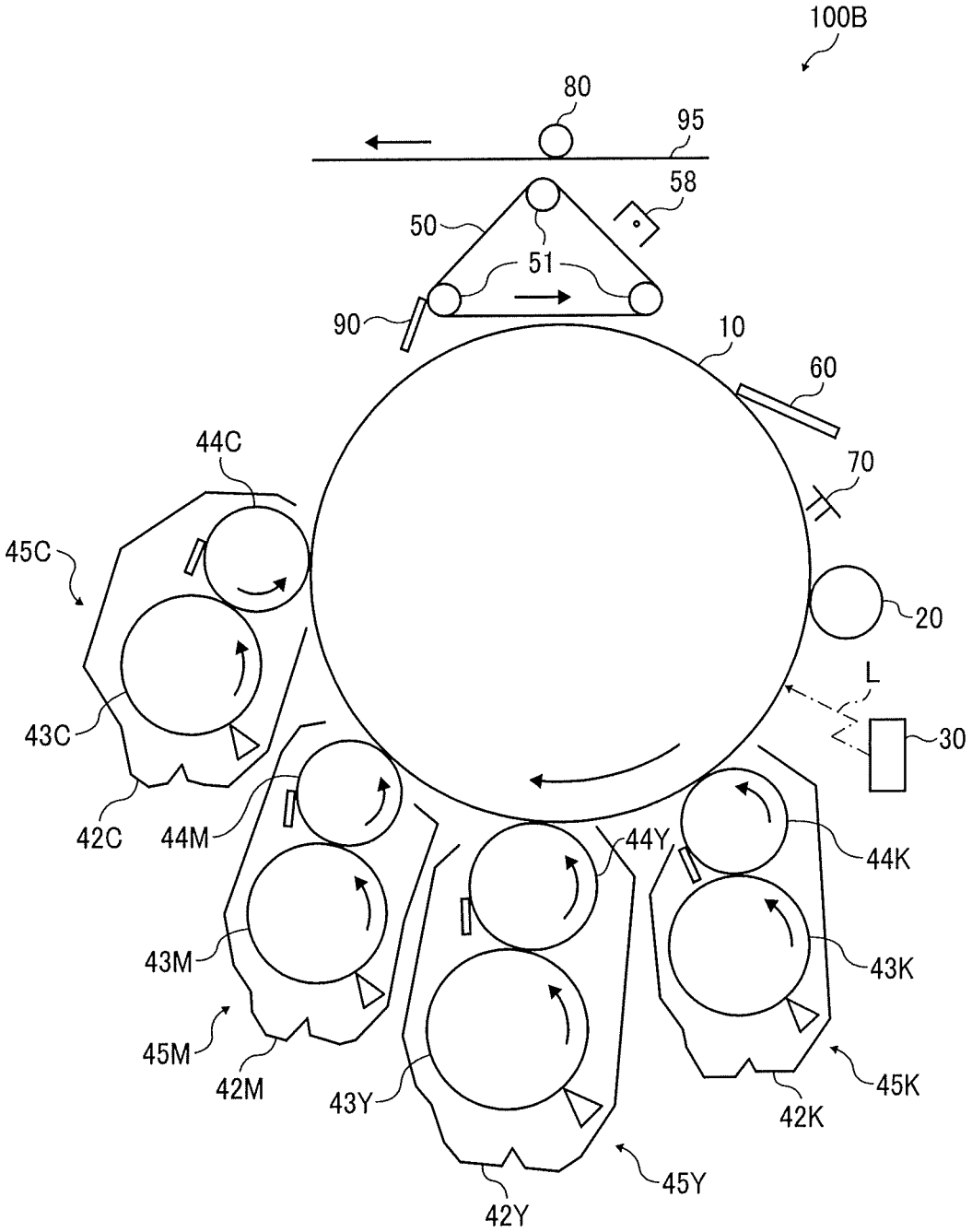
FIG. 5 is a schematic view of another image forming apparatus according to an embodiment of the present invention.

FIG. 5 is a schematic view of another image forming apparatus according to an embodiment of the present invention. An image forming apparatus 100B has a similar configuration to the image forming apparatus 100A illustrated in FIG. 4 except that the developing belt 41 is omitted and the black developing unit 45K, the yellow developing unit 45Y, the magenta developing unit 45M, and the cyan developing unit 45C are disposed facing the circumferential surface of the electrostatic latent image bearer 10.

Figure 6:
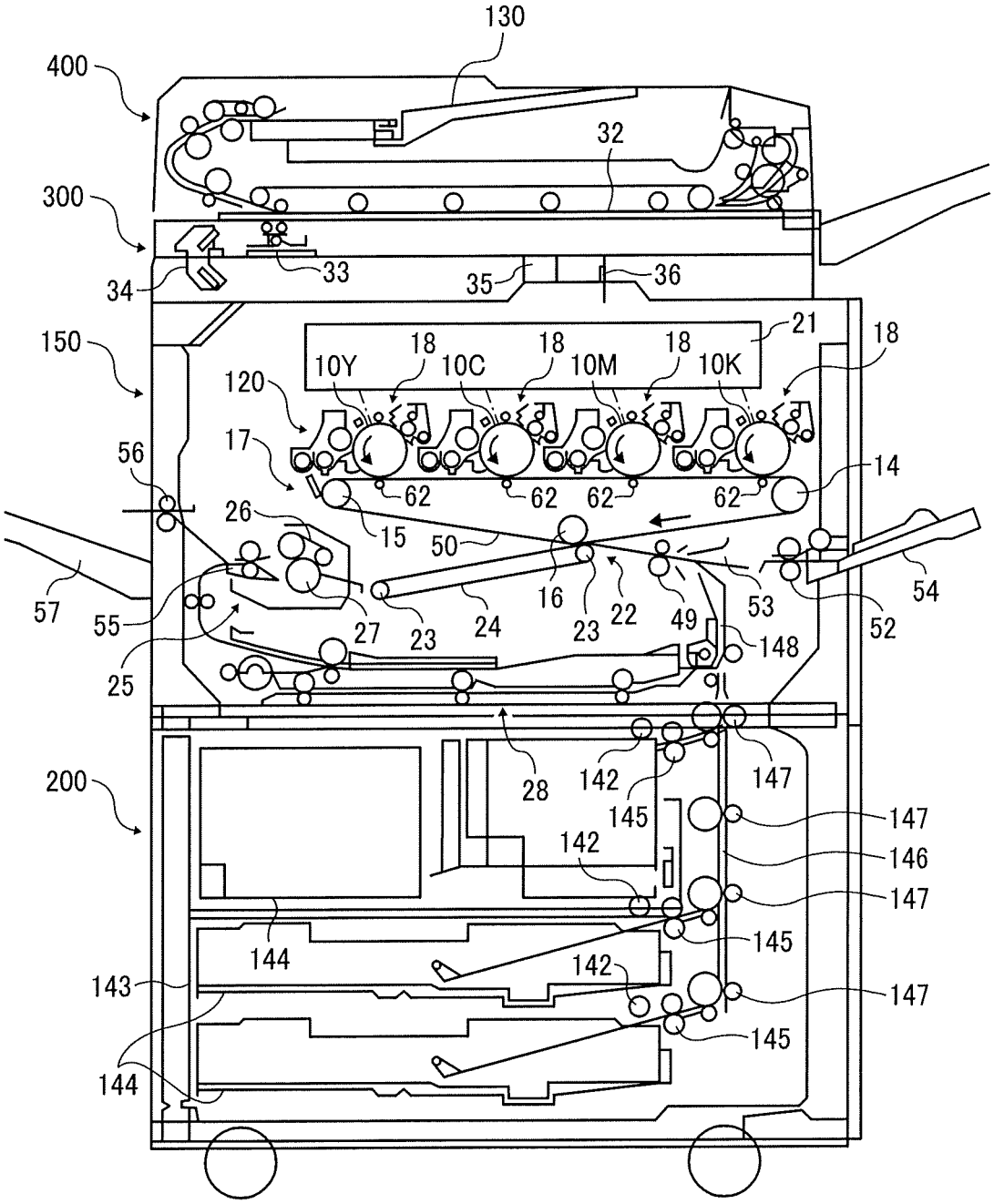
FIG. 6 is a schematic view of another image forming apparatus according to an embodiment of the present invention.

FIG. 6 is a schematic view of another image forming apparatus according to an embodiment of the present invention.

An image forming apparatus illustrated in FIG. 6 includes a copier main body 150, a sheet feeding table 200, a scanner 300, and an automatic document feeder (ADF) 400.

In the central part of the copier main body 150, an intermediate transfer medium 50 in the form of an endless belt is disposed.

The intermediate transfer medium 50 is stretched taut with support rollers 14, 15, and 16 and rotatable clockwise in FIG. 6. In the vicinity of the support roller 15, an intermediate transfer medium cleaner 17 for removing residual toner particles remaining on the intermediate transfer medium 50 is disposed. Four image forming units 18 for respectively forming yellow, cyan, magenta, and black images are arranged in tandem facing a part of the intermediate transfer medium 50 stretched between the support rollers 14 and 15 in the direction of conveyance of the intermediate transfer medium 50, thus forming a tandem developing device 120. In the vicinity of the tandem developing device 120, an irradiator 21 serving as the irradiator is disposed. On the opposite side of the tandem developing device 120 relative to the intermediate transfer medium 50, a secondary transfer device 22 is disposed. The secondary transfer device 22 includes a secondary transfer belt 24 in the form of an endless belt stretched taut with a pair of rollers 23. A transfer sheet conveyed on the secondary transfer belt 24 can contact the intermediate transfer medium 50. In the vicinity of the secondary transfer device 22, a fixing device 25 serving as the fixing device is disposed. The fixing device 25 includes a fixing belt 26 in the form of an endless belt and a pressing roller 27 pressed against the fixing belt 26.

In the vicinity of the secondary transfer device 22 and the fixing device 25, a recording medium reversing device 28 is disposed for reversing the transfer sheet so that images can be formed on both surfaces of the transfer sheet.

A full-color image forming (color copying) operation performed using the tandem developing device 120 is described below. First, a document is set on a document table 130 of the automatic document feeder 400. Alternatively, a document is set on a contact glass 32 of the scanner 300 while the automatic document feeder 400 is lifted up, followed by holding down of the automatic document feeder 400.

As a start switch is pressed, in a case in which a document is set to the automatic document feeder 400, the scanner 300 starts driving after the document is moved onto the contact glass 32; and in a case in which a document is set on the contact glass 32, the scanner 300 immediately starts driving. A first traveling body 33 and a second traveling body 34 thereafter start traveling. The first traveling body 33 directs light emitted from a light source to the document. A mirror carried by the second traveling body 34 reflects light reflected from the document containing a color image toward a reading sensor 36 through an imaging lens 35. Thus, the document is read by the reading sensor 36 and converted into image information of yellow, cyan, magenta, and black.

Figure 7:
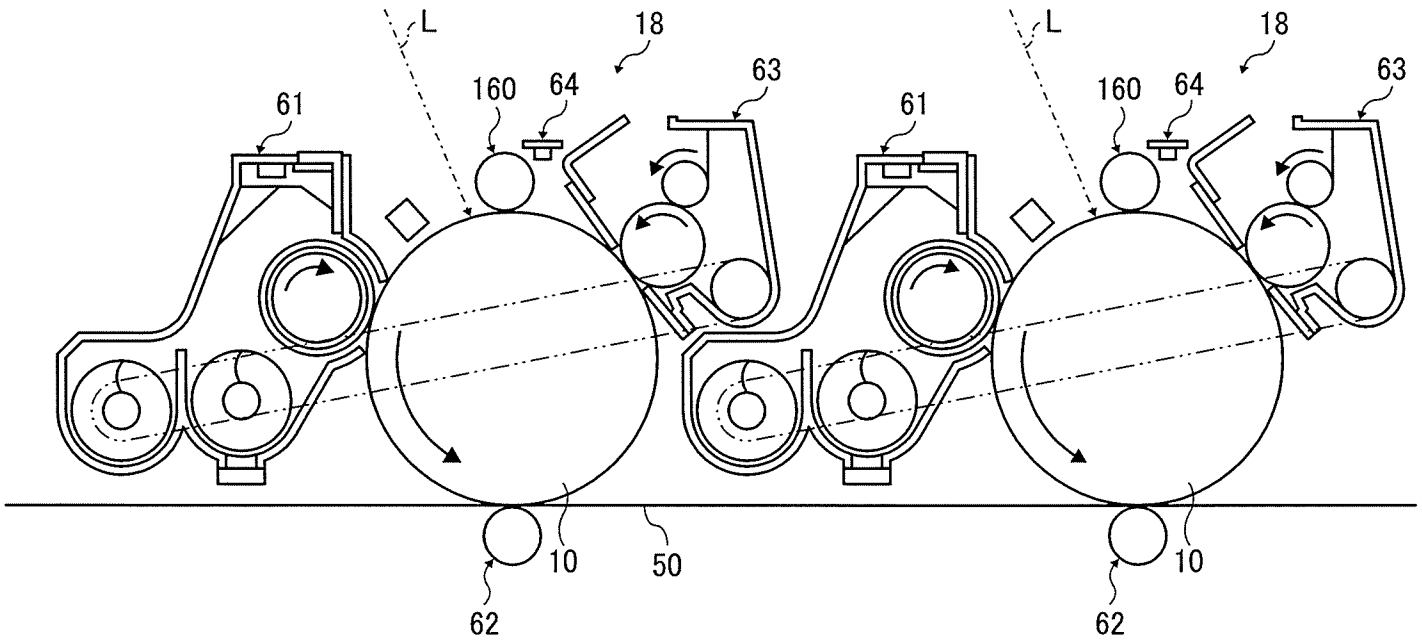
FIG. 7 is a partial magnified view of FIG. 6.

The image information of yellow, cyan, magenta, and black are respectively transmitted to the respective image forming units 18 (i.e., yellow image forming device, cyan image forming device, magenta image forming device, and black image forming device) included in the tandem developing device 120. The image forming units 18 form respective toner images of yellow, cyan, magenta, and black. As illustrated in FIG. 7, each of the image forming units 18 (i.e., yellow image forming device, cyan image forming device, magenta image forming device, or black image forming device) in the tandem developing device 120 includes: an electrostatic latent image bearer 10 (i.e., electrostatic latent image bearers 10Y, 10C, 10M, or 10K); a charger 160 to uniformly charge the electrostatic latent image bearer 10; an irradiator to irradiate the electrostatic latent image bearer 10 with light L based on the color image information to form an electrostatic latent image thereon; a developing device 61 to develop the electrostatic latent image with respective toner (i.e., yellow toner, cyan toner, magenta toner, or black toner) to form a toner image; a transfer charger 62 to transfer the toner image onto the intermediate transfer medium 50, a cleaner 63, and a neutralizer 64. Each image forming unit 18 forms a single-color toner image (i.e., yellow toner image, cyan toner image, magenta toner image, or black toner image) based on the image information of each color. The toner images of yellow, cyan, magenta, and black formed on the respective electrostatic latent image bearers 10Y, 10C, 10M, and 10K are primarily transferred in a sequential manner onto the intermediate transfer medium 50 that is rotated by the support rollers 14, 15, and 16. The toner images of yellow, cyan, magenta, and black are superimposed on one another on the intermediate transfer medium 50, thus forming a composite full-color toner image.

At the same time, in the sheet feeding table 200, one of sheet feeding rollers 142 starts rotating to feed a sheet of recording medium from one of sheet feeding cassettes 144 in a sheet bank 143. One of separation rollers 145 separates the sheets of recording medium one by one and feeds them to a sheet feeding path 146. Feed rollers 147 feed each sheet to a sheet feeding path 148 in the copier main body 150. The sheet is stopped upon striking a registration roller 49. Alternatively, sheets of recording medium may be fed from a manual feed tray 54. In this case, a separation roller 52 separates the sheets one by one and feeds it to a manual sheet feeding path 53. The sheet is stopped upon striking the registration roller 49. The registration roller 49 is generally grounded. Alternatively, the registration roller 49 may be applied with a bias for the purpose of removing paper powders from the sheet. The registration roller 49 starts rotating to feed the sheet to between the intermediate transfer medium 50 and the secondary transfer device 22 in synchronization with an entry of the composite full-color toner image formed on the intermediate transfer medium 50 thereto. The secondary transfer device 22 secondarily transfers the composite full-color toner image onto the sheet. Thus, the composite full-color image is formed on the sheet of recording medium. After the composite full-color image is transferred, residual toner particles remaining on the intermediate transfer medium 50 are removed by the intermediate transfer medium cleaner 17.

The sheet having the composite full-color toner image thereon is fed from the secondary transfer device 22 to the fixing device 25. The fixing device 25 fixes the composite full-color toner image on the sheet by application of heat and pressure. A switch claw 55 switches sheet feeding paths so that the sheet is ejected by an ejection roller 56 and stacked on a sheet ejection tray 57. Alternatively, the switch claw 55 may switch sheet feed paths so that the sheet is introduced into the recording medium reversing device 28 and gets reversed. The sheet is then introduced to the transfer position again so that another image is recorded on the back side of the sheet. Thereafter, the sheet is ejected by the ejection roller 56 and stacked on the sheet ejection tray 57.

Process Cartridge

A process cartridge according to an embodiment of the present invention includes at least an electrostatic latent image bearer and a developing device configured to store the toner according to an embodiment of the present invention and to develop an electrostatic latent image formed on the electrostatic latent image bearer with the toner into a toner image, and optionally other devices as necessary.

The process cartridge integrally supports the electrostatic latent image bearer and the developing device and can be detachably attachable to the image forming apparatus main body.

EXAMPLES

Further understanding can be obtained by reference to certain specific examples which are provided herein for the purpose of illustration only and are not intended to be limiting. In the descriptions in the following Examples, the numbers in parts represent mass ratios in parts, unless otherwise specified.

Production Example 1

Production of Matrix Resin M-1

A 5-liter four-neck flask equipped with a nitrogen inlet pipe, a dewatering pipe, a stirrer, and a thermocouple was charged with propylene glycol (as a diol) and dimethyl terephthalate and dimethyl adipate (each as a dicarboxylic acid) with the molar ratio of dimethyl terephthalate to dimethyl adipate being 90/10 and the ratio of OH groups to COOH groups being 1.2. The flask contents were allowed to react in the presence of 300 ppm of titanium tetraisopropoxide based on the total mass of the raw materials while allowing the produced methanol to flow out. The temperature was finally raised to 230° C. and the reaction was continued until the acid value of the produced resin became 5 mgKOH/g or less. The reaction was further continued under reduced pressures of from 20 to 30 mmHg until Mw reached 15,000. Subsequently, the reaction temperature was reduced to 180° C. and trimellitic anhydride was added. Thus, an amorphous polyester resin M-1, being an amorphous polyester resin having a carboxylic acid on its terminal, was obtained.

The obtained resin had an Mw of 15,000, an acid value (AV) of 18 mg KOH/g, and a glass transition temperature (Tg) of 58° C. The SP obtained by the Fedors' method was 11.8.

In addition, another matrix resin M-2 was obtained in the same manner as the matrix resin M-1 except for changing the blending ratio of dicarboxylic acids and diols according to the description of Table 1.

TABLE 1

| | Charging Ratio (Molar Ratio) | M-1 | M-2 |
|---|---|---|---|
| Diols | Propylene Glycol | 100 | 0 |
| | PO 2-mol Adduct of Bisphenol A | 0 | 100 |
| Dicarboxylic | Dimethyl Terephthalate | 90 | 80 |
| Acids | Dimethyl Adipate | 10 | 20 |
| Weight Average Molecular Weight (MW) | | 15000 | 16000 |
| Tg (° C.) | | 58 | 58 |
| Solubility Parameter (SP) | | 11.8 | 10.8 |

Production Example 2

Production of Domain Resin D-1

A 5-liter four-neck flask equipped with a nitrogen inlet pipe, a dewatering pipe, a stirrer, and a thermocouple was charged with 3-methyl-1,5-pentanediol and ethylene oxide 2-mol adduct of bisphenol A (each as a diol) and dimethyl terephthalate and dimethyl adipate (each as a dicarboxylic acid) with the molar ratio of 3-methyl-1,5-pentanediol to ethylene oxide 2-mol adduct of bisphenol A being 80/20, the molar ratio of dimethyl terephthalate to dimethyl adipate being 90/10, and the ratio of OH groups to COOH groups being 1.1. The flask contents were allowed to react in the presence of 300 ppm of titanium tetraisopropoxide based on the total mass of the raw materials while allowing the produced methanol to flow out. The temperature was finally raised to 230° C. and the reaction was continued until the acid value of the produced resin became 5 mgKOH/g or less. The reaction was further continued under reduced pressures of from 20 to 30 mmHg until Mw becomes 20,000. Thus, an amorphous polyester resin D-1, being a linear amorphous polyester resin, was obtained.

The obtained resin had an acid value (AV) of 0.35 mg KOH/g and a glass transition temperature (Tg) of −40° C. The SP obtained by the Fedors' method was 10.21.

In addition, other domain resins D-2 to D-5 were obtained in the same manner as the domain resin D-1 except for changing the blending ratio of dicarboxylic acids and diols according to the description of Table 2.

TABLE 2

| | Charging Ratio (Molar Ratio) | D-1 | D-2 | D-3 | D-4 | D-5 |
|---|---|---|---|---|---|---|
| Diols | 3-Methyl-1,5-Pentanediol | 80 | 80 | 90 | 100 | 0 |
| | EO 2-mol Adduct of Bisphenol A | 20 | 20 | 10 | 0 | 100 |
| Dicarboxylic Acids | Dimethyl Terephthalate | 10 | 20 | 30 | 50 | 30 |
| | Dimethyl Adipate | 90 | 80 | 70 | 50 | 70 |
| Weight Average Molecular Weight (MW) | | 20000 | 22000 | 24000 | 22000 | 24000 |
| Tg (° C.) | | −40 | −30 | −35 | −38 | 30 |
| Solubility Parameter (SP) | | 10.21 | 10.29 | 10.5 | 10.7 | 10.2 |

Production Example 3

Production of Crystalline Polyester Resin C1

A 5-liter four-neck flask equipped with a nitrogen inlet pipe, a dewatering pipe, a stirrer, and a thermocouple was charged with 1,9-nonanediol and dodecanedioic acid with the ratio of OH groups to COOH groups being 1.1. The flask contents were allowed to react in the presence of 300 ppm of titanium tetraisopropoxide based on the total mass of the raw materials while allowing the produced water to flow out. The temperature was finally raised to 230° C. and the reaction was continued until the acid value of the produced resin became 5 mgKOH/g or less. The reaction was further continued for 6 hours under reduced pressures of 10 mmHg or less. Thus, a crystalline polyester resin C1 is prepared.

The obtained resin had an acid value (AV) of 0.45 mgKOH/g and a melting point (Tm) of 70° C.

Production Example 4

Production of Colorant Master Batch P1

First, 100 parts of the matrix resin M-1, 100 parts of a cyan pigment (C.I. Pigment Blue 15:3), and 30 parts of ion-exchange water were mixed well. The mixture was then kneaded with an open-roll kneader (KNEADEX from and Mitsui Mining Company, Ltd.). The kneading was started with a temperature of 90° C., and the temperature was thereafter gradually reduced to 50° C. Thus, a colorant master batch P1 was prepared in which the mass ratio of the resin and the pigment was 1:1.

Production Example 5

Production of Wax Dispersion Liquid

A reaction vessel equipped with a condenser tube, a thermometer, and a stirrer was charged with 20 parts of a paraffin wax (HNP-9 from Nippon Seiro Co., Ltd., having a melting point of 75° C.) and 80 parts of ethyl acetate. The vessel contents were heated to 78° C. so that the wax was well dissolved in the ethyl acetate, and then cooled to 30° C. over a period of 1 hour while being stirred. The resulting liquid was subjected to a wet pulverization treatment using an ULTRAVISCOMILL (from Aimex Co., Ltd.) filled with 80% by volume of zirconia beads having a diameter of 0.5 mm, at a liquid feeding speed of 1.0 kg/hour and a disc peripheral speed of 10 m/sec. This dispersing operation was repeated 6 times (6 passes). An amount of ethyl acetate was added to adjust the solid content concentration. Thus, a wax dispersion liquid having a solid content concentration of 20% was prepared.

Example 1

Production of Toner 1

A vessel equipped with a thermometer and a stirrer was charged with 80 parts of the matrix resin M-1, 9 parts of the domain resin D-1, 5 parts of the crystalline polyester resin C1, and 94 parts of ethyl acetate. The vessel contents were heated to the melting points of the resins or above so that the resins were well dissolved in the ethyl acetate. Further, 25 parts of the wax dispersion liquid and 12 parts of the colorant master batch P1 were added to the vessel. The vessel contents were stirred by a TK HOMOMIXER (from PRIMIX Corporation) at a revolution of 10,000 rpm at 50° C. so that they were uniformly dissolved or dispersed. Thus, an oil phase 1 was prepared.

Another reaction vessel equipped with a stirrer and a thermometer was charged with 75 parts of ion-exchange water, 3 parts of a 25% liquid dispersion of fine particles of an organic resin (i.e., a copolymer of styrene, methacrylate, butyl acrylate, and sodium salt of sulfate of ethylene oxide adduct of methacrylic acid, available from Sanyo Chemical Industries, Ltd.) for dispersion stability, 1 part of carboxymethylcellulose sodium, 16 parts of a 48.5% aqueous solution of dodecyl diphenyl ether sodium disulfonate (ELEMINOL MON-7 from Sanyo Chemical Industries, Ltd.), and 5 parts of ethyl acetate. The vessel contents were mixed and stirred to prepare an aqueous phase liquid.

The aqueous phase liquid was mixed with 50 parts of the oil phase 1 using a TK HOMOMIXER (from PRIMIX Corporation) at a revolution of 12,000 rpm for 1 minute. Thus, an emulsion slurry 1 was prepared.

The emulsion slurry 1 was contained in a vessel equipped with a stirrer and a thermometer, and subjected to solvent removal for 2 hours at 50° C. Thus, a slurry 1 of of mother toner particles was prepared.

The slurry 1 in an amount of 100 parts was subjected to filtration under reduced pressures to obtain a filter cake. The filter cake was subjected to the following washing processes (1) to (4).

(1) The filter cake was mixed with 100 parts of ion-exchange water using a TK HOMOMIXER at a revolution of 6,000 rpm for 5 minutes and thereafter filtered.

(2) The filter cake of (1) was mixed with 100 parts of a 10% aqueous solution of sodium hydroxide using a TK HOMOMIXER at a revolution of 6,000 rpm for 10 minutes and thereafter filtered under reduced pressures.

(3) The filter cake of (2) was mixed with 100 parts of 10% aqueous solution of hydrochloric acid using a TK HOMOMIXER at a revolution of 6,000 rpm for 5 minutes and thereafter filtered.

(4) The filter cake of (3) was mixed with 300 parts of ion-exchange water using a TK HOMOMIXER at a revolution of 6,000 rpm for 5 minutes and thereafter filtered. This operation was repeated twice.

The resulting filter cake 1 was dried by a circulating air dryer at 45° C. for 48 hours and thereafter sieved with a mesh having an opening of 75 μm. Thus, a mother toner particle 1 was prepared.

The mother toner particle 1 in an amount of 100 parts was mixed with 1.0 part of a hydrophobized silica (HDK-2000 from Wacker Chemie AG) and 0.3 parts of a titanium oxide (MT-150AI from Tayca Corporation) using a HENSCHEL MIXER. Thus, a toner 1 was prepared.

Examples 2 to 4 and Comparative Examples 1 to 4

Toners 2 to 8 were prepared in the same manner as the toner 1 except for changing the combination of the matrix resin and the domain resin according to the description in Table

TABLE 3

| | Toner No. | Matrix Resin | Domain Resin |
|---|---|---|---|
| Example 1 | 1 | M-1 (Tg = 58° C., SP = 11.8) | D-1 (Tg = −40° C., SP = 10.8) |
| Example 2 | 2 | M-1 (Tg = 58° C., SP = 11.8) | D-2 (Tg = −30° C., SP = 10.29) |
| Example 3 | 3 | M-1 (Tg = 58° C., SP = 11.8) | D-3 (Tg = −35° C., SP = 10.5) |
| Example 4 | 4 | M-2 (Tg = 58° C., SP = 10.8) | D-1 (Tg = −40° C., SP = 10.8) |
| Comparative Example 1 | 5 | M-1 (Tg = 58° C., SP = 11.8) | D-5 (Tg = 30° C., SP = 10.2) |
| Comparative Example 2 | 6 | M-2 (Tg = 58° C., SP = 10.8) | D-2 (Tg = −30° C., SP = 10.29) |
| Comparative Example 3 | 7 | M-2 (Tg = 58° C., SP = 10.8) | D-3 (Tg = −35° C., SP = 10.5) |
| Comparative Example 4 | 8 | M-2 (Tg = 58° C., SP = 10.8) | D-4 (Tg = −38° C., SP = 10.7) |

Production of Carrier 1

As a core material, manganese (Mn) ferrite particles (having a weight average particle diameter of 35 μm) in an amount of 5,000 parts were used.

A coating liquid was prepared by dispersing the following materials with a stirrer for 10 minutes: 300 parts of toluene, 300 parts of butyl cellosolve, 60 parts of a toluene solution of an acrylic resin (the composition thereof being methacrylic acid:methyl methacrylate: 2-hydroxyethylacrylate=5:9:3 and the Tg thereof being 38° C.) having a solid content concentration of 50%, 15 parts of a toluene solution of a N-tetramethoxymethylbenzoguanamine resin (having a polymerization degree of 1.5) having a solid content concentration of 77%, and 15 parts of alumina particles (having an average primary particle diameter of 0.30 μm).

The core material and the coating liquid were put into a coating device equipped with a fluidized bed having a rotary bottom disc and agitation blades, configured to generate a swirling flow, so that the coating liquid was applied to the core material. The coated core material was calcined in an electric furnace at 220° C. for 2 hours. Thus, a carrier 1 was prepared.

Production of Developer 1

The carrier 1 in an amount of 100 parts and each of the toners 1 to 8 in an amount of 7 parts were uniformly mixed with a TURBLA® mixer (from Willy A. Bachofen AG), configured to perform mixing by rolling of a container, at a revolution of 48 rpm for 5 minutes. Thus, a developer 1, being a two-component developer, was prepared.

Evaluations

Properties of the above-prepared toners 1 to 8 were evaluated by the procedures described above. The developer 1 was loaded in the developing unit of the tandem-type image forming apparatus 100C illustrated in FIG. 6 to form images, and the performance thereof was evaluated by the procedures described below. The results are presented in Tables 4-1 and 4-2.

Evaluation of Low-Temperature Fixability (Lower-Limit Fixable Temperature)

A solid image with a toner deposition amount of 0.85±0.10 mg/cm$^2$ and an image area of 3 cm×8 cm was formed on sheets of a transfer paper (printing paper <70> from Ricoh Japan Co., Ltd.) and fixed on each sheet at various fixing belt temperatures. The fixed image was subjected to a scratch drawing test with a drawing tester AD-401 (from Ueshima Seisakusho Co., Ltd.) equipped with a ruby needle (having a point radius of from 260 to 320 μm and a point angle of 60 degrees) at a load of 50 g. The image surface was then strongly rubbed with a piece of a fabric (HONECOTTO #440 from SAKATA INX ENG. CO., LTD) for 5 times. The temperature of the fixing belt at which almost no peeling-off of the image occurred was determined as the lower-limit fixable temperature. The solid image was formed on a position on the sheet 3.0 cm away from the leading edge in the sheet feeding direction. The velocity of the sheet passing through the nip portion of the fixing device was 280 mm/s. As the lower-limit fixable temperature gets lower, the low-temperature fixability gets better.

Evaluation Criteria

A: Not higher than 120° C.

B: Higher than 120° C. and not higher than 130° C.

C: Higher than 130° C. and not higher than 140° C.

D: Higher than 140° C.

Evaluation of Heat-Resistant Storage Stability (Penetration)

A 50-mL glass vial was filled with each toner and left in a constant-temperature chamber at 50° C. for 24 hours, followed by cooling to 24° C. The toner was then subjected to a penetration test based on JIS K-2235-1991 to measure a penetration (mm). The greater the penetration, the better the heat-resistant storage stability. In a case in which the penetration is less than 5 mm, it is highly possible that a problem arises in practical use. The penetration here refers to the depth (mm) of penetration.

Evaluation Criteria

A: Penetration was not less than 25 mm.

B: Penetration was not less than 15 mm and less than 25 mm.

C: Penetration was not less than 5 mm and less than 15 mm.

D: Penetration was less than 5 mm.

Measurement of Gloss

An image fixed at a temperature higher than the lower-limit fixable temperature by 10 degrees and another image fixed at a temperature higher than the lower-limit fixable temperature by 40 degrees were subjected to a measurement of gloss with a gloss meter (VG-1D manufactured by NIPPON DEN SHOKU INDUSTRIES CO., LTD.). After conducting the zero adjustment while adjusting each of the projection angle and the light receiving angle to 60° and setting the S-S/10 switch to S and subsequently the standard setting using a standard plate, each image was placed on a sample stand and the gloss thereof was measured. The lower the gloss value, the better the low glossiness. The gloss change amount is defined by subtracting "the gloss of the image fixed at a temperature higher than the lower-limit fixable temperature by 10 degrees" from "the gloss of the image fixed at a temperature higher than the lower-limit fixable temperature by 40 degrees".

Evaluation Criteria

A: The gloss of the image fixed at a temperature higher than the lower-limit fixable temperature by 10 degrees was 5 or less, and the gloss change amount was not greater than 3.

B: The gloss of the image fixed at a temperature higher than the lower-limit fixable temperature by 10 degrees was 5 or less, and the gloss change amount was greater than 3 and not greater than 5.

D: The gloss of the image fixed at a temperature higher than the lower-limit fixable temperature by 10 degrees was 5 or greater, and the gloss change amount was greater than 5.

TABLE 4

| | Example 1 | Example 2 | Example 3 | Example 4 |
|---|---|---|---|---|
| Low-temperature Fixability | B | A | A | A |
| Heat-resistant Storage Stability | A | A | A | B |
| Measurement of Gloss | A | A | A | B |
| Specific requirement satisfied? | Yes | Yes | Yes | Yes |
| Glass Transition Temperature of Toner | 53° C. 0° C. | 50° C. 3° C. | 48° C. 7° C. | 48° C. 10° C. |
| Dispersion Diameter of First Phase-contrast Portions | 300 nm | 250 nm | 200 nm | 150 nm |

TABLE 4-2

| | Comparative Example 1 | Comparative Example 2 | Comparative Example 3 | Comparative Example 4 |
|---|---|---|---|---|
| Low-temperature Fixability | D | A | A | A |
| Heat-resistant Storage Stability | A | D | D | D |
| Measurement of Gloss | A | D | D | D |
| Specific requirement satisfied? | No | No | No | No |
| Glass Transition Temperature of Toner | 52° C. 42° C. | 43° C. | 40° C. | 35° C. |
| Dispersion Diameter of First Phase-contrast Portions | Not Observed *1 | Not Observed *2 | Not Observed *2 | Not Observed *2 |

*1 It is considered due to high Tg of domain resin and poor sensitivity of SPM measurement.
*2 50 nm or less It is clear from the results presented in Tables 4-1 and 4-2 that the toner of each Example forms an image having excellent low glossiness and also provides excellent low temperature fixability and heat resistant storage stability compared to the toner of each Comparative Example.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. A toner comprising:

a mother toner particle comprising a binder resin, wherein, when the toner is observed with an atomic force microscope (AFM) in tapping mode to obtain a phase image and the phase image is binarized with an intermediate value between maximum and minimum phase difference values in the phase image to obtain a binarized image, the binarized image consists of first phase-contrast portions having a large phase difference and second phase-contrast portions having a small phase difference, where the first phase-contrast portions are dispersed in the second phase-contrast portions and a dispersion diameter of the first phase-contrast portions is in a range of from 150 to 500 nm, and wherein the toner has at least two glass transition temperatures (Tg) in respective ranges of from 40° C. to 65° C. and from −30° C. to 20° C., determined from a DSC curve obtained at a first temperature rise in a differential scanning calorimetric (DSC) measurement by a midpoint method.

2. The toner according to claim 1, wherein the binder resin comprises at least two resins differing in solubility parameter determined by a Fedors' method by 0.5 or more.

3. The toner according to claim 1, wherein the binder resin comprises:

a matrix resin; and a domain resin having a glass transition temperature lower than a glass transition temperature of the matrix resin, wherein a mass ratio of the matrix resin to the domain resin is from 95/5 to 70/30.

4. A developer comprising the toner according to claim 1.

5. The toner according to claim 1, wherein the phase image is obtained by cutting the toner into a section under the following conditions:

Cutting thickness: 60 nm,

Cutting speed: 0.4 mm/sec, and

Knife: Diamond knife (Ultra Sonic 35°), and observing the section of the toner with the atomic force microscope (AFM) under the following conditions:

Target amplitude: 0.5 V,

Target percent: 5%,

Amplitude setpoint: 315 mV,

Scan rate: 1 Hz,

Scan points: 256×256, and

Scan angle: 0°.

6. The toner according to claim 2, wherein the at least two resins comprise at least two amorphous polyester resins.

7. The toner according to claim 1, wherein the dispersion diameter of the first phase-contrast portions is in a range of from 200 to 400 nm.

8. The toner according to claim 1, wherein the at least two glass transition temperatures (Tg) are in respective ranges of from 50° C. to 60° C. and from −10° C. to 10° C.

9. A developer for replenishment, comprising the toner according to claim 1.

10. A toner storage unit comprising:

a container; and the toner according to claim 1 stored in the container.

11. An image forming apparatus comprising:

an electrostatic latent image bearer;

an electrostatic latent image forming device configured to form an electrostatic latent image on the electrostatic latent image bearer; and a developing device containing the toner according to claim 1, configured to develop the electrostatic latent image with the toner into a toner image.

12. An image forming method comprising:

forming an electrostatic latent image on an electrostatic latent image bearer; and developing the electrostatic latent image with the toner according to claim 1 into a toner image.

* * * * *